US009841692B2

(12) United States Patent
Hasegawa et al.

(10) Patent No.: US 9,841,692 B2
(45) Date of Patent: Dec. 12, 2017

(54) TONER

(71) Applicant: CANON KABUSHIKI KAISHA, Tokyo (JP)

(72) Inventors: Yusuke Hasegawa, Suntou-gun (JP); Tomohisa Sano, Mishima (JP); Yoshitaka Suzumura, Mishima (JP); Kozue Uratani, Mishima (JP); Yuujirou Nagashima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/256,780

(22) Filed: Sep. 6, 2016

(65) Prior Publication Data

US 2017/0160660 A1 Jun. 8, 2017

(30) Foreign Application Priority Data

Dec. 4, 2015 (JP) ..... 2015-237660

(51) Int. Cl.
*G03G 9/087* (2006.01)
*G03G 9/08* (2006.01)

(52) U.S. Cl.
CPC ..... *G03G 9/0821* (2013.01); *G03G 9/0825* (2013.01); *G03G 9/08711* (2013.01); *G03G 9/08755* (2013.01); *G03G 9/08782* (2013.01)

(58) Field of Classification Search
CPC ..... G03G 9/08782; G03G 9/0821; G03G 9/08755; G03G 9/08711; G03G 9/0825
USPC ..... 430/109.4, 109.3
See application file for complete search history.

(56) References Cited

U.S. PATENT DOCUMENTS

| | | | |
|---|---|---|---|
| 6,586,151 | B1 | 7/2003 | Naka et al. |
| 6,803,164 | B2 | 10/2004 | Mizoo et al. |
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,524,434 | B2 * | 9/2013 | Tominaga ..... G03G 9/09314 430/109.1 |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,040,216 | B2 | 5/2015 | Fukudome et al. |
| 9,097,997 | B2 | 8/2015 | Nomura et al. |
| 9,152,065 | B2 | 10/2015 | Sano et al. |
| 9,158,216 | B2 | 10/2015 | Shimano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,377,708 | B2 | 6/2016 | Magome et al. |
| 9,417,542 | B2 | 8/2016 | Hiroko et al. |
| 9,423,710 | B2 | 8/2016 | Magome et al. |
| 9,423,711 | B2 | 8/2016 | Uratani et al. |
| 9,442,416 | B2 | 9/2016 | Magome et al. |
| 9,454,096 | B2 | 9/2016 | Hasegawa et al. |
| 2009/0197192 | A1 | 8/2009 | Hiroko et al. |
| 2011/0281214 | A1 | 11/2011 | Kuroyama |
| 2012/0045717 | A1 | 2/2012 | Hiroko et al. |
| 2014/0140731 | A1 | 5/2014 | Hozumi et al. |

(Continued)

FOREIGN PATENT DOCUMENTS

| | | |
|---|---|---|
| JP | 2010-145550 | 7/2010 |
| JP | 2011-237801 | 11/2011 |
| JP | 2013-015673 | 1/2013 |
| JP | 2013-137420 | 7/2013 |
| JP | 2014-026275 | 2/2014 |
| JP | 2014-211632 | 11/2014 |

OTHER PUBLICATIONS

U.S. Appl. No. 15/191,707, filed Jun. 24, 2016, Satoshi Arimura.

(Continued)

*Primary Examiner* — Janis L Dote
(74) *Attorney, Agent, or Firm* — Fitzpatrick Cella Harper & Scinto

(57) ABSTRACT

Provided is a toner having a toner particle that contains a binder resin, a colorant, a wax, and a crystalline polyester, wherein two or more peak tops for crystallization peaks are present in a temperature range from 40° C. to 80° C. in a first DSC curve obtained by a process or cooling the toner from 100° C. to 20° C. at 0.5° C./min, and using ΔH(0.5) for the exothermic quantity for the peak on the lowest temperature side of these crystallization peaks and using ΔH(100) for the exothermic quantity of the crystallization peak on the lowest temperature side in a second DSC curve obtained by a process of cooling the toner from 100° C. to 20° C. at 100° C./min, the ratio [ΔH(100)/ΔH(0.5)] is at least 2.0 and not more than 6.0.

10 Claims, 2 Drawing Sheets

(56) References Cited

U.S. PATENT DOCUMENTS

| | | | | |
|---|---|---|---|---|
| 2014/0302437 | A1* | 10/2014 | Shimano | G03G 9/0806 430/137.15 |
| 2015/0185658 | A1 | 7/2015 | Wakabayashi et al. | |
| 2015/0227067 | A1 | 8/2015 | Sano et al. | |
| 2015/0227068 | A1 | 8/2015 | Sano et al. | |
| 2016/0139521 | A1 | 5/2016 | Tsuda et al. | |
| 2016/0154331 | A1 | 6/2016 | Tanaka et al. | |
| 2016/0266509 | A1 | 9/2016 | Sano et al. | |

OTHER PUBLICATIONS

U.S. Appl. No. 15/259,114, filed Sep. 8, 2016, Yoshitaka Suzumura.
U.S. Appl. No. 15/259,293, filed Sep. 8, 2016, Yoshitaka Suzumura.
U.S. Appl. No. 15/333,297, filed Oct. 25, 2016, Shiro Kuroki.

* cited by examiner

TONER

BACKGROUND OF THE INVENTION

Field of the Invention

The present invention relates to a toner that is used in recording methods that use, for example, an electrophotographic process.

Description of the Related Art

Image-forming apparatuses, e.g., copiers, printers, and so forth, have in recent years been subjected to increasing diversification with regard to their intended applications and their use environment, and along with this, higher speeds, higher image quality, and higher stability are being required. At the same time, copiers and printers are also undergoing device downsizing and advances in energy conservation.

Optimization of each of the electrophotographic process steps is critical for responding to the increases in image quality and greater energy conservation of recent years. With regard to the image quality in particular, optimization of the developing step, in which an electrostatic latent image is developed with toner to form a toner image, has been crucial. With regard to the energy conservation, the execution of a satisfactory fixing at low temperatures is crucial.

The use in toner of a crystalline polyester that induces the melt deformation of the toner particle by rapidly compatibilizing into the binder resin in the toner has been widely investigated in recent years as a means for improving the fixing performance (refer to Japanese Patent Application Laid-open No. 2013-137420, Japanese Patent Application Laid-open No. 2013-15673, and Japanese Patent Application Laid-open No. 2011-237801). At around its melting point, a crystalline polyester that has a strong effect on the low-temperature fixability readily compatabilizes into the binder resin and a rapid melt deformation by the toner during fixing is facilitated. Due to this, the low-temperature fixability of the toner is improved by the use of a crystalline polyester. In addition, the co-use of a wax can provide the toner with the ability to release from the fixing unit and thus can also be expected to provide additional improvements in the fixing performance.

However, since the crystalline polyester has the property of readily compatibilizing into the binder resin, the presence of the crystalline polyester at the toner particle surface is then facilitated and a lowering of the charging stability of the toner is readily induced. A lowering of the charging stability of the toner facilitates a lowering of the image density through a reduction in the developing performance. Moreover, storage in a severe environment of repetitive temperature increases and decreases (also referred to below as heat cycling) facilitates outmigration to the toner particle surface by the crystalline polyester compatibilized in the binder resin. As a result, the surface composition of the toner ends up fluctuating pre-versus-post-heat cycling and, for example, properties such as the fogging and so forth then undergo a substantial decline.

To respond to this problem, investigations have been carried out into lowering the amount of crystalline polyester that compatibilities into the binder resin. This lowering of the amount of compatibilization means achieving a state in which the crystalline polyester has a high degree of crystallinity. Investigations such as the following have been carried out in relation to toner production methods aimed at inducing the crystallization of the crystalline polyester. In accordance with Japanese Patent Application Laid-open No. 2010-145550, the degree of crystallinity of the crystalline polyester is enhanced through control of the cooling rate. In accordance with Japanese Patent Application Laid-open No. 2014-211632, the degree of crystallinity is enhanced by providing an annealing treatment step during cooling.

However, there is room for improvement with regard to Japanese Patent Application Laid-open No. 2010-145550 and Japanese Patent Application Laid-open No. 2014-211632 from the standpoint of reducing the charging stability caused by the presence of crystalline polyester at the toner particle surface and from the standpoint of the resistance to heat-cycling environments when the assumption is made of, for example, various logistics.

Moreover, when trying to focus on the fixing step from the perspective of the demand for higher image quality, a problem that shows up accompanying the diversification in the intended applications and the use environment is the problem of offset at the back end of a high print percentage image in high-temperature, high-humidity environments.

When, in the fixing step, the paper bearing the unfixed toner image is passed through the fixing unit (the transit region in particular is called the fixing nip herebelow), in general the toner is fixed to the paper by the application of heat and pressure.

The reason that offset is more severe with a high print percentage image than with a low print percentage image is thought likely to reside in the amount of heat applied to the toner layer. With higher print percentage images, the amount of heat from the fixing unit is dispersed into larger amounts of toner, and due to this a trend is set up of an increasing amount of toner that is inadequately melted. That is, a state is assumed in which the occurrence of fixing defects is facilitated.

Moreover, the amount of heat applied from the fixing nip part declines as the back end of the paper is approached, and due to this the occurrence of an unfavorable fixing performance at the back end of the paper is facilitated.

In particular, this offset phenomenon tends to become severe with paper that has been held in a high-temperature, high-humidity environment. This is hypothesized to likely be due to the following: when paper containing large amounts of moisture due to a holding period is passed through the fixing unit, water vapor is generated from the paper in the fixing nip part due to the heat received from the fixing unit and as a result the toner layer on the paper is forced toward the fixing film side.

That is, the appearance of the aforementioned offset phenomenon is facilitated when paper that has been held in a high-temperature, high-humidity environment is used under the circumstance that the occurrence of defective fixing at the back end of a high print percentage image is facilitated.

Improvements have been made, for example, the design of a low softening temperature, in order to improve the fixing performance of toner from the existing situation. However, with such a design, while the thermal melting behavior is improved in regions where heat is adequately applied, where the amount of heat applied is not adequate, for example, at the back end of a high print percentage image, the melting speed of the toner does not catch up and the suppression of back end offset with a high print percentage image has thus been quite problematic. In view of the preceding, there is demand for a toner that, even in a high-temperature, high-humidity environment, can suppress the occurrence of back end offset with a high print percentage image and that, even after exposure to a history of heat cycling, can provide a high-quality, fogging-inhibited image.

SUMMARY OF THE INVENTION

The present invention provides a toner that solves the problems described above.

More particularly, a toner is provided that can yield a high quality image that suppresses the occurrence of back end offset with a high print percentage image and that does so even in a high-temperature, high-humidity environment.

In addition, a toner is provided that can yield a high-quality, fogging-inhibited image even after exposure to a history of heat cycling.

As a result of intensive and extensive investigations, the present inventors discovered that the problems described above can be solved by the toner described below and thus achieved the present invention.

That is, the present invention is a toner that has a toner particle that contains a binder resin, a colorant, a wax, and a crystalline polyester, wherein the toner, has two or more peak tops for crystallization peaks in a temperature range from 40° C. to 80° C. in a first DSC curve, the first DSC curve being obtained using a differential scanning calorimeter (DSC) by a process of heating to 100° C. and thereafter cooling the toner from 100° C. to 20° C. at 0.5° C./min, and the toner satisfies the following formula $$2.0 \leq (\Delta H(100)/\Delta H(0.5)) \leq 6.0$$

where

ΔH(0.5) represents an exothermic quantity (J/g) for the crystallization peak on the lowest temperature side of the two or more crystallization peaks in the first DSC curve, and ΔH(100) represents an exothermic quantity (J/g) for the crystallization peak on the lowest temperature side of crystallization peaks having peak tops present in a temperature range from 40° C. to 80° C. in a second DSC curve, the second DSC curve being obtained using the DSC by a process of heating the toner to 100° C. and thereafter cooling the toner from 100° C. to 20° C. at 100° C./min.

The present invention can provide a toner that can produce a high quality image that suppresses the occurrence of back end offset with a high print percentage image and does so even in a high-temperature, high-humidity environment. In addition, a toner can be provided that can produce a high image quality for which fogging is suppressed even after exposure to a history of heat cycling.

Further features of the present invention will become apparent from the following description of exemplary embodiments (with reference to the attached drawings).

DESCRIPTION OF THE EMBODIMENTS

Figure 1:
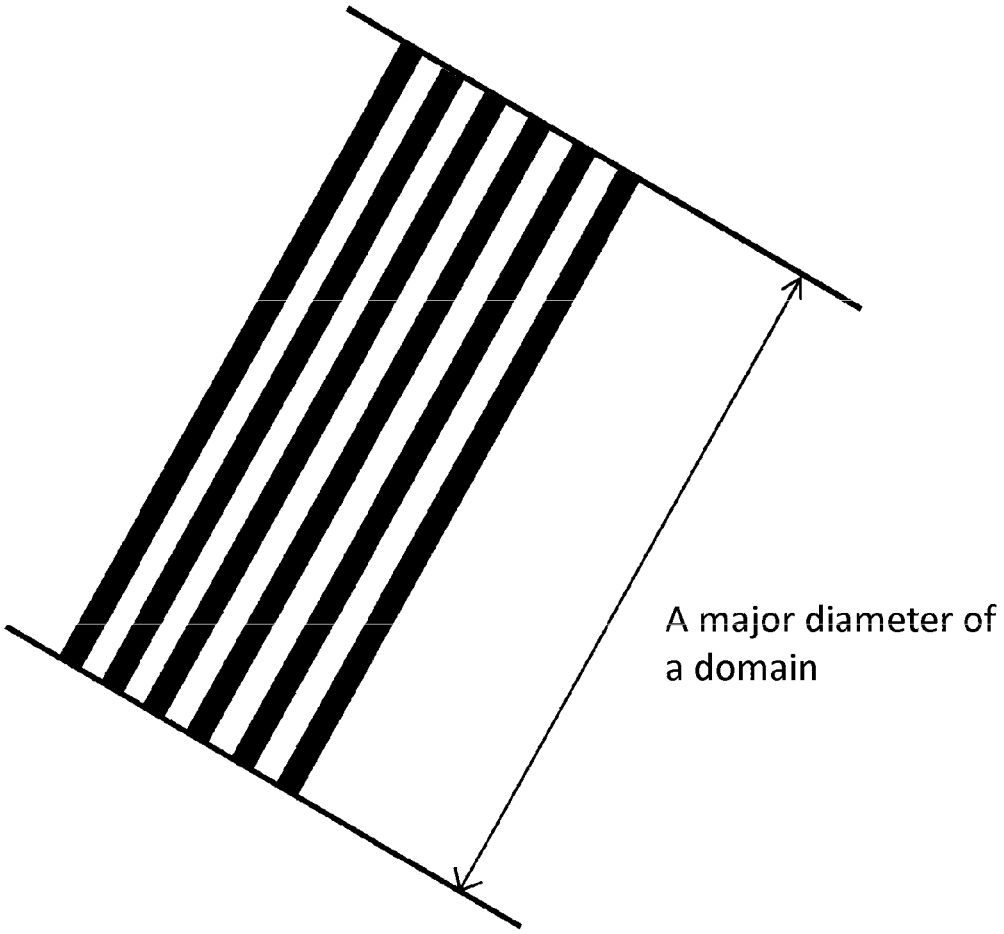
FIG. 1 is a schematic diagram of a domain of a crystalline polyester.

The present invention is described in detail in the following, but this should not be taken to mean that the present invention is limited to or by the following.

The present invention is a toner that has a toner particle that contains a binder resin, a colorant, a wax, and a crystalline polyester.

Moreover, it is a toner for which two or more peak tops are present for crystallization peaks in a temperature range from 40° C. to 80° C. in a first DSC curve, the first DSC curve being obtained using a differential scanning calorimeter (DSC) by a process of heating the toner to 100° C. and thereafter cooling the toner from 100° C. to 20° C. at 0.5° C./min, and for which the ratio between ΔH(100) and ΔH(0.5) [ΔH(100)/ΔH(0.5)] is at least 2.0 and not more than 6.0 where ΔH(0.5) represents the exothermic quantity (J/g) for the crystallization peak on the lowest temperature side of the aforementioned two or more crystallization peaks and ΔH(100) represents the exothermic quantity (J/g) for the crystallization peak on the lowest temperature side of crystallization peaks having peak tops present in a temperature range from 40° C. to 80° C. in a second DSC curve, the second DSC curve being obtained using a differential scanning calorimeter (DSC) by a process of heating the toner to 100° C. and thereafter cooling the toner from 100° C. to 20° C. at 100° C./min.

First, back end offset appears with a high print percentage image in a high-temperature, high-humidity environment. In particular, it is readily produced at the back end of the paper.

As discussed above, the reason that offset is more severe with a high print percentage image than with a low print percentage image is presumed to reside in the amount of heat applied to the toner layer. With higher print percentage images, the amount of heat from the fixing unit is dispersed into larger amounts of toner, and due to this a trend is set up of increasing amounts of toner that are inadequately melted. That is, a state is assumed in which the occurrence of fixing defects is facilitated.

Moreover, the amount of heat applied from the fixing nip part readily declines as the back end of the paper is approached. As a result, an unfavorable fixing performance is facilitated to a greater degree at the back end of the paper and due to this back end offset is more readily produced.

When paper containing large amounts of moisture is passed through the fixing unit, water vapor is produced due to the heat from the fixing unit at the fixing nip part. When the fixing performance of the toner is satisfactory, toner-to-toner binding occurs and fixing occurs so the fibers of the paper, and due to this an excellent image is obtained even when a high print percentage image is output.

When, on the other hand, the fixing performance by the toner on the paper is inadequate, the toner is pressed by the water vapor from the paper toward the fixing film. As a result, when a high print percentage image is output, the production of a speckled image, which presents scattered blank dots, is facilitated.

That is, when paper that has been held in a high-temperature, high-humidity environment and that contains a large amount of moisture is used under the circumstance that the occurrence of defective fixing at the back end of a high print percentage image is facilitated, an image occurs that is speckled at the back end of the paper.

This back end offset can be suppressed when the previously specified behavior is exhibited in measurement of the toner with a differential scanning calorimeter (DSC).

That is, the presence of two or more peak tops for crystallization peaks in a temperature range from 40° C. to 80° C. in the first DSC curve obtained by the previously described measurement process means that the toner contains two or more crystalline substances that have a peak, top for a crystallization peak in this temperature range. The number of crystallization peak tops from 40° C. to 80° C. is preferably not more than 5 and is more preferably at least 2 and not more than 3.

It is critical for the toner of the present invention to contain a crystalline polyester from the standpoint of facile crystallization as a crystalline substance therein. In addition, the crystallization peak on the lowest temperature side of the two or more crystallization peaks preferably originates from this crystalline polyester. More preferably both ΔH(100) and ΔH(0.5) are exothermic quantities for crystallization peaks that originate from this crystalline polyester.

The heating to 100° C. provides a temperature that is sufficiently higher than the crystallization peak temperatures and that causes the crystalline substances present in the toner to temporarily assume a completely amorphous state. It is thought that, at the high temperature condition of 100° C., the crystalline substances that have assumed an amorphous state assume a compatible state with the binder resin constituting the toner.

The cooling rate of 0.5° C./min is thought to be a sufficiently slow cooling rate. Even for a crystalline substance that has a relatively slow crystallization rate, a cooling rate of around 2.0° C./min facilitates crystallization and also supports the appearance of a large crystallization peak. Measurement is carried out in the present invention at a sufficiently slow cooling rate of 0.5° C./min in order to analyze the crystallization peaks with a high reproducibility.

A cooling rate of 100° C./min, on the other hand, is thought to be a sufficiently rapid cooling rate. For a crystalline substance that has a relatively slow crystallization rate, when the cooling rate is 50° C./min, even in the vicinity of the temperature of the crystallization peak crystallization is suppressed and the appearance of a small crystallization peak is also facilitated. Measurement is carried out in the present invention at a sufficiently rapid cooling rate of 100° C./min in order, as above, to analyze the crystallization peaks wish a high reproducibility.

Based on these premises, and using ΔH(100) for the exothermic quantity (J/g) for the crystallization peak on the lowest temperature side of the crystallization peaks during cooling from 100° C. to 20° C. at 100° C./min and using ΔH(0.5) for the exothermic quantity (J/g) for the crystallization peak on the lowest temperature side of the crystallization peaks during cooling from 100° C. to 20° C. at 0.5° C./min, it is critical that the ratio between ΔH(100) and ΔH(0.5) [ΔH(100)/ΔH(0.5)] be at least 2.0 and not more than 6.0.

First, the fact that the crystallization peak on the lowest temperature side, of the plurality of crystallization peaks, is larger at the rapid cooling rate suggests the operation of an interaction with the crystalline substance that has its crystallization peak on the higher temperature side.

In particular, a ΔH(100)/ΔH(0.5) of at least 2.0 suggests that this interaction is very strong.

While the mechanism here is not clear, the present inventors hypothesize as follows.

It is thought that the strength of the interaction is also influenced, as described below, by the type and amount of addition of the different crystalline substances. The present inventors believe that, by ΔH(100)/ΔH(0.5) being at least 2.0, a very strong interaction can be expressed because the different crystalline substances in the toner particle, while being microfinely dispersed throughout the whole, are present in proximity to each other throughout the whole.

Moreover, in order to control to a regime in which, for the crystallization peak on the lowest temperature side, the peak is larger at the rapid cooling rate, the incorporation is preferred of a crystalline substance that readily assumes a higher degree of crystallinity than the crystalline substance having its crystallization peak on the higher temperature side.

On this point, a crystalline polyester that readily assumes a high degree of crystallinity is preferred for the crystalline substance that has its crystallization peak on the lower temperature side. Moreover, the crystalline substance having its crystallization peak on the higher temperature side is preferably a crystalline substance that has the effect of promoting the crystallization of crystalline polyester. For example, the crystallization peak on the higher temperature side preferably originates from a wax, e.g., an ester wax.

By providing a toner that inhibits the DSC behavior described above, the crystalline substance having the crystallization peak on the lower temperature side not only readily assumes a high crystallinity, but a speeding up of the rate of plasticization of the surrounding binder resin at lower temperatures during fixing is also made possible.

It is thought that, as has been described above, through the microdispersion of a crystalline substance that has its crystallization peak at a low temperature and that readily assumes a high degree of crystallinity, a rapid plasticization of the toner particle as a whole is made possible and as a result back end offset can be suppressed even at the back end of high print percentage images.

When, on the other hand, the crystalline polyester outmigrates to the toner particle surface, the charging stability of the toner then undergoes a substantial decline and the electrophotographic properties, such as the fogging and so forth, end up declining. In addition, even when outmigration to the toner particle surface does not occur, when the crystalline polyester is compatibilized in the binder resin, the crystalline polyester—when held in a severe environment that is strongly influenced by, e.g., temperature and humidity—undergoes an annealing process and crystallizes and ends up outmigrating to the toner particle surface.

According to investigations by the present inventors that focused on this crystallization phenomenon, when a crystalline polyester is crystallized in an aqueous medium, the crystalline polyester readily crystallizes in an encapsulated state in the toner particle. When, on other hand, the crystalline polyester is crystallized in the air, the crystalline polyester then, conversely, crystallizes while outmigrating to the surface of the toner particle.

Thus, the phenomenon whereby the presence of the crystalline polyester is changed-depending on the environment in which crystallization occurs can be described in terms of the hydrophilicity hydrophobicity of the crystalline polyester and the environment that surrounds it. Crystalline polyesters are hydrophobic. Aqueous media, on the other hand, are hydrophilic, and air is hydrophobic. Thus, when crystallization is carried out in an aqueous medium, the affinity between the water and the crystalline polyester is low and the presence of the crystalline polyester at the toner particle surface is suppressed. Conversely, when crystallization occurs in air, as in a harsh environment, the affinity between the air and the crystalline polyester is high and outmigration by the crystalline polyester to the toner particle surface is facilitated.

That is, by satisfying the DSC behavior described in the preceding, at normal temperature encapsulation occurs while the degree of crystallinity of the crystalline polyester is enhanced, and during fixing the surrounding binder resin can be plasticized rapidly and at a lower temperature.

In particular, through the facilitation of an increase in the degree of crystallinity for the crystalline polyester having its crystallization peak on the lowest temperature side, even when, for example, heat cycling is imposed and an amorphous state is assumed under the high temperature condition, a rapid return to the crystalline state is facilitated and as a result outmigration to the surface is suppressed. That is, even when a heat cycling history is imposed, there is little fluctuation in the surface properties of the toner and a high-quality, fogging-inhibited image is readily obtained.

ΔH(100)/ΔH(0.5) is preferably not more than 6.0 because this facilitates the selection of the type of crystalline polyester and wax and their amounts of addition.

ΔH(100)/ΔH(0.5) is preferably at least 2.5 and not more than 5.5 and is more preferably at least 2.5 and not more than 5.0. ΔH(0.5) can be controlled through, for example, the type and amount of addition of the crystalline substances.

This ΔH(100) is preferably at least 2.5 J/g and not more than 15.0 J/g and is more preferably at least 4.0 J/g and not more than 13.0 J/g.

Having ΔH(100) be in the indicated range is preferred from the standpoint of the inhibition of back end offset and the inhibition of fogging after a heat cycling history.

ΔH(100) can be controlled through, for example, a suitable selection of the crystalline substance content and the types of the plurality of incorporated crystalline substances.

In particular, when ΔH(100) is at least 2.5 J/g, the degree of crystallinity of the crystalline polyester is readily raised and increases in the compatible component are suppressed and due to this fogging after a heat cycling history can be inhibited.

ΔH(0.5), on the other hand, is preferably at least 0.5 J/g and not more than 3.5 J/g.

In addition, Tp and Tw preferably satisfy the relationship in the following formula (1)

$$5 \leq Tw - Tp \leq 30 \quad (1)$$

wherein, Tp (° C.) is the peak temperature of the crystallization peak (Pp) of the crystalline polyester measured with the DSC by the process of cooling the toner from 100° C. to 20° C. at 0.5° C./min, and Tw (° C.) is the peak temperature of the crystallization peak (Pw) of the wax measured with the DSC by the process of cooling the toner from 100° C. to 20° C. at 0.5° C./min.

Preferably Tw≤100 and 40≤Tp.

The operation of the wax as a nucleating agent for the crystalline polyester is facilitated by having formula (1) be satisfied. The operation of this nucleating process tends to be impaired when the crystallization temperatures of the wax and crystalline polyester are very close and the value of (Tw−Tp) is less than 5 or, conversely, when they are widely separated and the value of (Tw−Tp) exceeds 30.

Tw−Tp preferably is at least 5 and not more than 20. Tw and Tp can be controlled through the type of wax and the type of crystalline polyester.

A plurality of crystalline polyesters and a plurality of waxes can also be used in the present invention. In such cases, the wax with the lowest crystallization peak temperature and the crystalline polyester with the lowest crystallization peak preferably satisfy formula (I).

The peak temperature Tw (° C.) for crystallization of the wax used in present invention is more preferably at least 50° C. and not more than 90° C.

The wax can be exemplified by the following: aliphatic hydrocarbon waxes such as low molecular weight polyethylene, low molecular weight polypropylene, microcrystalline wax, Fischer-Tropsch waxes, and paraffin waxes; oxides of aliphatic hydrocarbon waxes, such as oxidized polyethylene wax, and their block copolymers; waxes in which the major component is fatty acid ester, such as carnauba wax and montanic acid ester waxes, and waxes provided by the partial or complete deacidification of fatty acid esters, such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained, for example, by the hydrogenation of plant oils.

The wax in the present invention preferably contains an ester wax. Through the interaction between the ester bond present in an ester wax and the ester bond present in the crystalline polyester, the development of crystal growth by the crystalline polyester is facilitated with the ester wax acting as a crystal nucleus and an additional increase in the degree of crystallinity of the crystalline polyester is facilitated.

The ester wax in the present invention is preferably any of an ester compound of a dihydric alcohol and an aliphatic monocarboxylic acid, and an ester compound of a dibasic carboxylic acid and an aliphatic monoalcohol. When the number of ester bonds in the ester wax is increased, the compatibility of the ester wax with the binder resin is enhanced and an increase in the number of crystal nuclei formed is facilitated. When, on the other hand, the number of ester bonds in the ester wax is reduced, the effect of the ester bond-mediated interaction with the crystalline polyester is enhanced and crystal growth by the crystalline polyester is promoted.

The condensation product of a $C_{6-12}$ aliphatic alcohol and a long-chain carboxylic acid and the condensation product of a $C_{4-10}$ aliphatic carboxylic acid and a long-chain alcohol can be used in a construction in which the ester wax contains one ester bond. While any long-chain carboxylic acid and any long-chain alcohol can be used here, monomer combinations are preferred that enable the melting points in the present invention to be satisfied. The long-chain carboxylic acid and long-chain alcohol preferably have, for example, at least 18 and not more than 34 carbons.

The aliphatic alcohol can be exemplified by 1-hexanol, 1-heptanol, 1-octanol, 1-nonanol, 1-decanol, undecyl alcohol and lauryl alcohol. The aliphatic carboxylic acid can be exemplified by pentanoic acid, hexanoic acid, heptanoic acid, octanoic acid, nonanoic acid, and decanoic acid.

Compared to a construction in which the ester wax contains one ester bond, a construction that contains two provides a higher compatibility with the binder resin and assumes a trend of an increasing number of crystal nuclei formed. As a result, the promotion of crystal growth by the crystalline polyester is facilitated.

The combination or a dicarboxylic acid (preferably at least 6 and not more than 12 carbons) and a monoalcohol (preferably at least 12 and not more than 28 carbons) and the combination of a diol (preferably at least 6 and not more than 12 carbons) and a monocarboxylic acid (preferably at least 12 and not more than 28 carbons) are preferred for a construction in which the ester wax contains two ester bonds.

The dicarboxylic acid can be exemplified by adipic acid, pimelic acid, suberic acid, azelic acid, decanedioic acid, and dodecanedioic acid.

The diol can be exemplified by 1,6-hexanediol, 1,7-heptanediol, 1,8-octanediol, 1,9-nonanediol, 1,10-decanediol, 1,11-undecanediol, and 1,12-dodecanediol. Straight-chain fatty acids and straight-chain alcohols have been provided here as examples, but these may also have branched structures. Among the preceding, 1,6-hexanediol, 1,9-nonanediol, 1,10-decanediol, and 1,12-dodecanediol are preferred, while 1,9-nonanediol and 1,10-decanediol are particularly preferred for facilitating achieving the effects of the present invention.

The monoalcohol for condensation with the dicarboxylic acid is preferably an aliphatic monoalcohol. Specific examples are tetradecanol, pentadecanol, hexadecanol, heptadeconol, octadecanol, nonadecanol, eicosanol, docosanol, tricosanol, tetracosanol, pentacosanol, hexacosanol, and octacosanol. Docosanol is preferred among the preceding from the standpoint of the fixing performance and the developing performance.

The monocarboxylic acid for condensation with the diol is preferably an aliphatic monocarboxylic acid. Specific examples are fatty acids such as lauric acid, myristic acid, palmitic acid, margaric acid, stearic acid, tuberculostearic acid, arachidic acid, behenic acid, lignoceric acid, and cerotic acid. Behenic acid is preferred among the preceding from the standpoint of the fixing performance and developing performance.

A construction in which the ester wax contains three or more ester bonds can be exemplified by the condensation product of a glycerol compound with an aliphatic monocarboxylic acid. A tetrafunctional ester wax can be exemplified by the condensation product of pentaerythritol and an aliphatic monocarboxylic acid and the condensation product of diglycerol and a carboxylic acid. A pentafunctional ester wax can be exemplified by the condensation product of triglycerol with an aliphatic monocarboxylic acid. A hexafunctional ester wax can be exemplified by the condensation product of dipentaerythritol and an aliphatic monocarboxylic acid and the condensation product of tetraglycerol and an aliphatic monocarboxylic acid.

In the case of tetrafunctional and higher functional ester waxes, an enhanced ester wax-to-ester wax interaction is facilitated and as a result a declining trend is assumed for the interaction between the crystalline polyester and the ester wax. Due to this, a trend is assumed of a suppression of the promotion of the crystal growth of the crystalline polyester.

In addition, a trend is assumed with tetrafunctional and higher functional ester waxes of a declining charging stability for the toner and a facilitation of a reduction in the developing performance, because the compatibility with the binder resin is readily excessively enhanced and the wax outmigrates to the toner surface.

When an ester wax is used in the present invention, the use of an ester wax having a controlled composition distribution is more preferred. In the composition distribution when the ester was is measured by GC-MASS or MALDI TOF MASS, the proportion of the ester compound having the largest content (the proportion for the component with the largest content) relative to the total amount of the ester wax is preferably at least 40 mass % and not more than 80 mass %. This means that the ester wax has a composition distribution and represents the degree of this composition distribution.

It is crucial for bringing about a microdispersion of the crystalline polyester that crystal nuclei of the ester wax form in large amounts in the interior of the toner particle. For this purpose the degree of crystallinity of the ester wax must be restrained to a certain degree. By having the composition of the ester wax exhibit a distribution, the crystallization rate of the ester wax is reduced in comparison to that of an ester wax having a single composition and the formation of crystal nuclei in large amounts is facilitated, and this is thus preferred.

In a more preferred range for the composition distribution of the ester wax, the proportion of the ester compound having the largest content relative to the total amount of the ester wax is preferably at least 50 mass % and not more than 80 mass %, in the composition distribution when the ester wax is measured by GO-MASS or MALDI TOF MASS.

Expressed as the total amount relative to 100 mass parts or the binder resin, the content of the wax present in the toner is preferably at least 2.5 mass parts and not more than 25.0 mass parts, more preferably at least 4.0 mass parts and not more than 20.0 mass parts, and even more preferably at least 6.0 mass parts and not more than 15.0 mass parts.

The content of the ester wax is preferably at least 3 mass parts and not more than 20 mass parts per 100 mass parts of the binder resin.

The crystalline polyester (CPES) is described in the following.

Known crystalline polyesters can be used for the crystalline polyester, but the condensation product of an aliphatic dicarboxylic acid and an aliphatic diol is preferred. A saturated polyester is even more preferred. Examples of preferred monomers are provided in the following.

Aliphatic dicarboxylic acids can be exemplified by oxalic acid, malonic acid, succinic acid, glutaric acid, adipic acid, pimelic acid, suberic acid, azelaic acid, sebacic acid, and dodecanedioic acid.

Aliphatic diols can be specifically exemplified by ethylene glycol, diethylene glycol, triethylene glycol, 1,2-propylene glycol, 1,3-propylene glycol, dipropylene glycol, trimethylene glycol, neopentyl glycol, 1,4-butanediol, 1,5-pentanediol, 1,6-hexanediol, 1,7-heptanediol, 1,8-octanediol, 1,9-nonanediol, 1,10-decanediol, 1,11-undecanediol, and 1,12-dodecanediol.

Viewed from the standpoint of the crystallinity of the crystalline polyester, the content of straight-chain aliphatic dicarboxylic acid in the carboxylic acid component is preferably at least 80 mol % and not more than 100 mol % and more preferably at least 90 mol % and not more than 100 mol % and is even more preferably 100 mol %.

Viewed from standpoint of the crystallinity of the crystalline polyester, the content of straight-chain aliphatic diol in the polyol component is preferably at least 80 mol % and not more than 100 mol % and more preferably at least 90 mol % and not more than 100 mol % and is even more preferably 100 mol %.

The crystalline polyester preferably has at least 90 mass % and not more than 100 mass % of the condensation product of a dicarboxylic acid and diol. Here, the ratio between the dicarboxylic acid and diol condensation product can be calculated from the integration values in the spectrum obtained for the crystalline polyester by nuclear magnetic resonance spectroscopic analysis ($^1$H-NMR).

The peak temperature Tp (° C.) for crystallization of the crystalline polyester used in the present invention is preferably at least 45° C. and not more than 65° C.

The crystalline polyester used in the present invention can be produced by the usual methods for synthesizing polyesters. For example, it can be obtained by carrying out an esterification reaction between the dicarboxylic acid component and diol component or running a transesterification reaction, followed by carrying out a polycondensation reaction by an ordinary method under reduced pressure or with the introduction of nitrogen gas.

A common esterification catalyst or transesterification catalyst, e.g., sulfuric acid, tertiary-butyltitanium butoxide, dibutyltin oxide, manganese acetate, magnesium acetate, and so forth, can be used on an optional basis in the esterification or transesterification reaction. A known polymerization catalyst can be used for the polymerization, e.g., an ordinary polymerization catalyst such as tertiary-butyltitanium butoxide, dibutyltin oxide, tin acetate, zinc acetate, tin disulfide, antimony trioxide, germanium dioxide, and so forth. There are no particular limitations on the polymerization temperature and the amount of catalyst, and any selection may be made as necessary.

A titanium catalyst is desirably used for this catalyst, and a chelate-type titanium catalyst is even more desirable. This is because titanium catalysts have a suitable reactivity and a polyester having a molecular weight distribution desirable for the present invention is obtained.

The weight-average molecular weight (Mw) of the crystalline polyester is preferably at least 4,000 and not more than 40,000 and is more preferably at least 10,000 and not more than 30,000. The reason for this is that, while maintaining a high degree of crystallinity for the crystalline polyester, the plasticizing effect due to the crystalline polyester can be rapidly obtained in the fixing step.

When the weight-average molecular weight (Mw) is not more than 40,000, a reduction in the solubility of the crystalline polyester itself is suppressed, the toner productivity is enhanced, and the generation of the back end offset suppression effect is facilitated accompanying an improved developing performance and an improved fixing performance.

When, on the other hand, the weight-average molecular weight (Mw) is at least 4,000, outmigration by the crystalline polyester to the toner surface is impaired and an excellent charging stability by the toner is assumed.

The weight-average molecular weight (Mw) of the crystalline polyester can be controlled using the various conditions in production of the crystalline polyester.

The acid value of the crystalline polyester is preferably controlled to low values considering the dispersibility in the toner. The preferred range is at least 0.5 mg KOH/g and not more than 8.0 mg KOH/g. At least 1.0 mg KOH/g and not more than 5.0 mg KOH/g is more preferred, and at least 1.0 mg KOH/g and not more than 3.5 mg KOH/g is still more preferred.

The crystalline polyester used in the present invention may be a block polymer that has a crystalline polyester segment and a vinyl polymer segment. A block polymer is defined as a polymer structured of a plurality of linearly connected blocks (The Society of Polymer Science, Japan; Glossary of Basic Terms in Polymer Science by the Compendium of Macromolecular Nomenclature of the International Union of Pure and Applied Chemistry), and the present invention also operates according to this definition.

Specific methods such as below are available for the structure and content of the crystalline polyester and ester wax, and thus the description here is by way of example. First, the toner is extracted with tetrahydrofuran to remove a large portion of the resin component. Here, components other than the resin fraction, e.g., the magnetic body, external additive, and so forth, are removed in advance by centrifugal separation utilizing specific gravity differences. The remaining resin fraction is a mixture of the crystalline polyester and the release agent, e.g., the ester wax, and due to this the crystalline polyester and release agent are respectively separated by preparative LC and their structures are determined by structural analysis, e.g., nuclear magnetic resonance spectroscopic analysis ($^1$H-NMR) and so forth.

The following is done for the contents in the toner. For example, to obtain the content of the crystalline polyester, the respective nuclear magnetic resonance spectroscopic analytical results for the toner and the post-fractionated crystalline polyester are compared and the area ratios for the peaks characteristic of the crystalline polyester are acquired. For the ester wax, the content can be obtained in the same manner through the peak area ratios according to the results of nuclear magnetic resonance spectroscopic analysis.

Preferably the ester wax satisfies the following condition (i) or (ii):

(i) in the ester wax, the proportion of a partial structure given by formula (1) below in alcohol component-derived partial structures is at least 90 mass % and not more than 100 mass %;

(ii) in the ester wax, the proportion of a partial structure given by formula (2) below in acid component-derived partial structures is at least 90 mass % and not more than 100 mass %, and the crystalline polyester satisfies the following condition (iii) or (iv):

(iii) in the crystalline polyester, the proportion of a partial structure given by formula (1) below in alcohol component-derived partial structures is at least 90 mass % and not more than 100 mass %;

(iv) in the crystalline polyester, the proportion of a partial structure given by formula (2) below in acid component-derived partial structures is at least 90 mass % and not more than 100 mass %.

[C1]

(1) $—C_xH_{2x}—O—$ x is an integer from 6 to 12

(2)

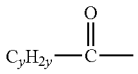

y is an integer from 4 to 10

Here, hydrogen or oxygen is bonded to the left end of the hydrocarbon chain in formula (1). In addition, hydrogen or a carbonyl group is bonded to the left end of the hydrocarbon chain in formula (2).

The proportions for these partial structures refer to proportions on a mass basis. For example, when 95 mass % of an ester wax corresponding to formula (1) is used with 5 mass % of an ester wax that does not correspond to either formula (1) or (2), the proportion of the partial structure with formula (1) is then 95 mass %.

As a result of intensive investigations, the present inventors discovered that, for a toner that contains a polyester that is crystalline to a certain degree, the microdispersion and crystallization of the crystalline polyester in the toner can be promoted by combining, at a specific blending ratio, a specific crystalline polyester and a specific ester wax. Simultaneously achieving microdispersion and crystallization facilitates the co-existence in good balance of the inhibition of the aforementioned back end offset with the suppression of fogging after exposure to a heat cycling history.

The thinking of the present inventors with regard to the microdispersion and crystallization of the crystalline polyester is described in the following. Various investigations have been carried out on inducing the crystallization of crystalline polyester, and art in this regard has been disclosed, for example, on the co-use of nucleating agents and waxes. According to investigations by the present inventors, both molecular structures preferably incorporate specific similar structures. Specifically these are structures as follows.

First, the crystalline polyester preferably has a hydrocarbon chain of a certain length as its main chain. In formulas (1) and (2) above, the length of the main chain is set by the values of x and y. When these are equal to or greater than the lower limits, the crystallinity is enhanced, and, for example, encapsulation within the toner is promoted when the toner is produced in an aqueous medium, and this is thus preferred. On the other hand, at equal to or less than the upper limits, a good solubility by the crystalline polyester is obtained and a back end offset inhibiting effect is readily obtained accompanied by an enhanced productivity for the toner and an enhanced fixing performance. Either of x and y should satisfy the ranges for formula (1) or (2), but preferably both x and y satisfy the ranges for formula (1) or (2). Specifically, x is preferably 6 to 12 and y is preferably 4 to 10. In addition, the sum of x and y also affects the fixing performance and the durability. Specifically, x+y is preferably 14 to 20.

The ester wax that can be used by the present invention preferably satisfies the structures given above. In addition, the peat top temperature (melting point) of the endothermic peak in measurement of the ester wax by differential scanning calorimetry is preferably at least 65° C. and not more than 85° C. and is more preferably at least 68"C and not more than 80° C.

With reference to the melting point, the storability is excellent at equal to or greater than the lower limit on the aforementioned range and the fixing performance is excellent at equal to or less than the upper limit. With reference to the structure, on the other hand, the incorporation of a structure similar to the crystalline polyester is preferred. The thinking of the present inventors on this with regard to the promotion of dispersion and the promotion of crystallization is as follows.

First, with regard to the promotion of dispersion, the presence of similar or common structures causes the solubility parameters to be very close in part. In general, a high affinity is provided when the solubility parameters are close to each other, and it is thought that, due to this, for a crystalline polyester and ester wax that have similar structures, affinity is encouraged at these structural elements. A characteristic feature of the ester wax that meets the melting point range indicated above is that, for example, when comparing the compatibility relative to a styrene-acrylic resin, it tends to be higher than for a hydrocarbon wax. This compatibility means mixing and dispersion in the binder resin have occurred at the molecular level, and it is thought that the properties of this ester wax substantially promote the dispersion of the crystalline polyester.

With regard to the promotion of crystallization, the process of crystallization by the crystalline polyester will be considered. For a crystalline polyester with a molecular chain of a certain length, it is known that crystallization occurs, through folding of the molecular chain, in a form in which main chain segments are aligned. Due to this, the present inventors think that the presence of a structure resembling the main chain also in the ester wax functions as a starting point for crystallization and crystallization is then substantially promoted.

In addition to the adjustment of the structures of both the crystalline polyester and the ester wax as described in the preceding, the amount of addition for the crystalline polyester and the ratio between the amounts of addition for the two are preferably adjusted. Specifically, the toner of the present invention contains preferably at least 3 mass parts and not more than 15 mass parts and more preferably at least 5 mass parts and not more than 12 mass parts of the crystalline polyester per 100 mass parts of the binder resin. In addition, the mass ratio between the wax (preferably ester wax) and the crystalline polyester (wax/crystalline polyester) is preferably 1/3 to 3/1 and is more preferably 2/3 to 2/1.

With regard to the amount of addition of the crystalline polyester, a satisfactory inhibition of back end offset is obtained when this is at least 3 mass parts while an excellent developing performance is obtained when this is not more than 15 mass parts. When, on the other hand, the mass ratio between the wax (preferably ester wax) and the crystalline polyester is at least γ/3, the appearance of the dispersion-promoting effect of the wax is facilitated and the back end offset can be suppressed. At not more than 3/1, on the other hand, the ratio for the wax-to-wax interaction does not become excessively high and crystallization of the wax itself can be suppressed and the effects of the present invention are then readily obtained.

Viewed from the standpoint of the charging stability of the toner, the total amount of the crystalline polyester and wax, expressed per 100 mass parts of the binder resin, is preferably at least 5 mass parts and not more than 30 mass parts and is more preferably at least 10 mass parts and not more than 25 mass parts.

When, as described above, the wax has an ester bond, the ester wax functions as crystal nuclei due to the ester bond-to-ester bond interaction of the wax and crystalline polyester, and the development of crystal growth by the crystalline polyester is thereby facilitated and an increase in the degree of crystallinity for the crystalline polyester is facilitated.

In the case, on the other hand, of, e.g., a paraffin wax, which lacks the ester bond, for example, preferably the wax is added in larger amounts relative to the crystalline polyester in order to obtain the effects of the present invention. In addition, a large amount of the crystalline polyester itself is preferably also added.

A plurality of crystalline polyesters and a plurality of waxes (preferably ester waxes) may also be used in the present invention, and the aforementioned amount of addition for the crystalline polyester and the ratio between the amounts of addition of the wax and crystalline polyester are to be considered in terms of the total amount of addition of the plurality of species.

Focusing once again on the structure of the crystalline polyester from the standpoint of crystallization, when the acid monomer-derived structure and alcohol monomer-derived structure are also structures similar to each other, the degree of crystallinity of the crystalline polyester is then easily increased, and this is thus preferred. Specifically the difference between the x and y in the aforementioned formulas (1) and (2) preferably is not more than 10 and more preferably is not more than 8. The reason for this is thought to be that a construction in which there is high affinity between the main chains is more advantageous during the molecular chain folding and crystallization described above.

The colorant used in the present invention can be exemplified by the following organic pigments, organic dyes, and inorganic pigments.

The cyan colorant can be exemplified by copper phthalocyanine compounds and derivatives thereof, anthraquinone compounds, and basic dye lake compounds. Specific examples are as follows: C.I. Pigment Blue 1, 7, 15, 15:1, 15:2, 15:3, 15:4, 60, 62, and 66.

The magenta colorant can be exemplified by the following: condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples are as follows: C.I. Pigment Red 2, 3, 5, 6, 7, 23, 48:2, 48:3, 48:4, 57:1, 31:1, 122, 144, 146, 150, 166, 169, 177, 184, 185, 202, 206, 220, 221, and 254 and C.I. Pigment Violet 19.

The yellow colorant can be exemplified by condensed azo compounds, isoindolinone compounds, anthraquinone compounds, azo-metal complexes, methine compounds, and allylamide compounds. Specific examples are as follows: C.I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Black colorants can be exemplified by carbon black and black colorants provided by color mixing to yield a black color using the aforementioned yellow colorants, magenta colorants, cyan colorants, and magnetic bodies. These colorants may be used individually or as mixtures or can be used in the form of a solid solution. The colorant used in the present invention is selected considering the hue angle, chroma, lightness, lightfastness, and OHP transparency and the dispersibility in the toner.

When a magnetic body is used as a colorant in the toner of the present invention, the magnetic body has as its main component a magnetic iron oxide such as triiron tetroxide or γ-iron oxide, and may contain an element such as phosphorus, cobalt, nickel, copper, magnesium, manganese, aluminum, silicon, and so forth. This magnetic body has a BET specific surface area by the nitrogen adsorption method preferably of 2 to 30 $m^2/g$ and more preferably of 3 to 28 $m^2/g$. Its Mobs hardness is preferably 5 to 7. The shape of the magnetic body is, for example, polyhedral, octahedral, hexahedral, spherical, acicular, or scale, and a low-anisotropy magnetic body, e.g., polyhedral, octahedral, hexahedral, spherical, and so forth, is preferred from the standpoint of increasing the image density.

The amount of colorant addition is preferably at least 1 mass parts and not more than 20 mass parts per 100 mass parts of the binder resin. When a magnetic powder is used, expressed per 100 mass parts of the binder resin, at least 20 mass parts and not more than 200 mass parts is preferred and at least 40 mass parts and not more than 150 mass parts is more preferred.

The magnetic body preferably has a number-average particle diameter of 0.10 μm to 0.40 μm. In general, a smaller particle diameter for the magnetic body raises the tinting strength while also facilitating aggregation of the magnetic body, and due to this the indicated range is preferred from the standpoint of a uniform dispersibility by the magnetic body in the toner.

In addition, a number-average particle diameter of at least 0.10 μm suppresses the assumption of a reddish black by the magnetic body itself; in particular, a reddish tinge in halftone images is made inconspicuous and high-quality images are readily obtained. When, on the other hand, the number-average particle diameter is not more than 0.40 μm, the toner has an excellent tinting strength and a uniform dispersion is easily brought about in the suspension polymerization method (see below).

The number-average particle diameter of the magnetic body can be measured using a scanning transmission electron microscope. Specifically, the toner particles to be observed are thoroughly dispersed in an epoxy resin followed by curing for 2 days in an atmosphere with a temperature of 40° C. to obtain a cured material. A thin-section sample is prepared from this cured material using a microtome, and the particle diameters of 100 magnetic bodies are measured in the field of observation of a 10,000× to 40,000× photograph using a scanning transmission electron microscope (STEM). The number-average particle diameter is calculated based on the circle-equivalent diameter of the projected area of the magnetic body. The particle diameter can also be measured with an image analyzer.

The magnetic body used in the toner of the present invention can be produced, for example, by the following method. An alkali, e.g., sodium hydroxide, is added in at least an equivalent amount with reference to the iron component to an aqueous solution of a ferrous salt to prepare an aqueous solution containing ferrous hydroxide. Air is blown in while keeping the pH of the prepared aqueous solution at 7 or above, and an oxidation reaction is carried out on the ferrous hydroxide while heating the aqueous solution to at least 70° C. to first produce seed crystals that will form the core for the magnetic iron oxide powder.

Then, ferrous sulfate is added, in an amount that is approximately 1 equivalent based on the amount of addition of the previously added alkali, to the seed crystal-containing slurry. While maintaining the pH of the solution at 5 to 10 and blowing in air, the reaction of the ferrous hydroxide is developed in order to grow a magnetic iron oxide powder using the seed crystal as cores. Here, the shape and magnetic properties of the magnetic body can be controlled by free selection of the pH, reaction temperature, and stirring conditions. The pH of the solution transitions to the acidic side as the oxidation reaction progresses, but the pH of the solution preferably does not drop below 5. The magnetic body obtained proceeding in this manner is filtered, washed, and dried by standard methods to obtain the magnetic body.

Moreover, when the toner is produced in an aqueous medium in the present invention, a hydrophobic treatment of the magnetic body surface is strongly preferred. When this surface treatment is carried out by a dry method, the washed, filtered and dried magnetic body is subjected to treatment with a coupling agent. When this surface treatment is carried out by a wet method, the coupling treatment, is carried out with redispersion of the dried material after the completion of the oxidation reaction or with redispersion, in a separate aqueous medium without drying, of the iron oxide obtained by washing and filtration after the completion of the oxidation reaction. Either a dry method or a wet method may be selected as appropriate in the present invention.

The coupling agents that can be used for surface treatment of the magnetic body in the present invention can be exemplified by silane coupling agents and titanium coupling agents. The use is more preferred of a silane coupling agent or a silane compound, as given by general formula (I).

$$R_mSiY_n \quad (I)$$

[In the formula, R represents an alkoxy group; m represents an integer from 1 to 3; Y represents a functional group, e.g., alkyl group, phenyl group, vinyl group, epoxy group, (meth) acryl group; and n represents an integer front 1 to 3; with the proviso that m+n=4.]

The silane coupling agent or silane compound given by general formula (I) can be exemplified by vinyltrimethoxysilane, vinyltriethoxysilane, vinyltris(β-methoxyethoxy)silane, β-(3,4-epoxycyclohexylethyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane. The use of a compound in which Y in general formula (I) is an alkyl group is preferred in the present invention. $C_3$ to $C_6$ alkyl groups are preferred in this regard and $C_3$ or $C_4$ alkyl is particularly preferred.

In the case of use of a silane coupling agent, treatment may be carried out with a single one or may be carried out using a plurality of species in combination. When the combination of a plurality of species is used, a separate treatment may be performed with each individual coupling agent or a simultaneous treatment may be carried out.

The total treatment amount for the coupling agent used is preferably at least 0.9 mass parts and not more than 3.0 mass parts per 100 mass parts of the magnetic body, and it is important to adjust the amount of the treatment agent in conformity with the surface area of the magnetic body, the reactivity of the coupling agent, and so forth.

The following can be used as the binder resin used in the toner of the present invention: homopolymers of styrene and substituted styrene, e.g., polystyrene and polyvinyltoluene; styrene copolymers, e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resin, polyester resin, polyamide resin, epoxy resin, and polyacrylic acid resin. A single one of these can be used or a combination of a plurality of species can be used. Viewed in terms of the developing properties and the fixing performance, styrene-acrylic resins as typified by styrene-butyl acrylate are preferred in particular among the preceding.

A styrene-acrylic resin is preferably the major component of the binder resin in the present invention. Styrene-acrylic resins are sparingly compatible with crystalline polyesters and due to this the degree of crystallinity of the crystalline polyester is readily increased. The preferred content of the styrene-acrylic resin with respect to the binder resin is at least 80 mass % and not more than 100 mass %.

The polymerizable monomer that forms this styrene-acrylic resin can be exemplified by the following.

Styrenic polymerizable monomers can be exemplified by styrenic polymerizable monomers such as styrene, α-methylstyrene, o-methylstyrene, m-methylstyrene, p-methylstyrene, and p-methoxystyrene.

Acrylic polymerizable monomers can be exemplified by acrylic polymerizable monomers such as methyl acrylate, ethyl acrylate, n-propyl acrylate, isopropyl acrylate, n-butyl acrylate, isobutyl acrylate, tert-butyl acrylate, n-hexyl acrylate, 2-ethylhexyl acrylate, n-octyl acrylate, and cyclohexyl acrylate.

Methacrylic polymerizable monomers can be exemplified by methacrylic polymerizable monomers such as methyl methacrylate, ethyl methacrylate, n-propyl methacrylate, isopropyl methacrylate, n-butyl methacrylate, isobutyl methacrylate, tert-butyl methacrylate, n-hexyl methacrylate, 2-ethylhexyl methacrylate, and n-octyl methacrylate.

There are no particular limitations on the method of producing the styrene-acrylic resin, and a known method can be used. In addition, combinations of other known resins can also be used for the binder resin.

A charge control agent may be used in the toner of the present invention in order to maintain stable charging characteristics for the toner regardless of the environment.

Negative-charging charge control agents can be exemplified by the following: monoazo metal compounds; acetylacetone metal compounds; metal compounds of aromatic oxycarboxylic acids, aromatic dicarboxylic acids, oxycarboxylic acids, and dicarboxylic acids; aromatic oxycarboxylic acids and aromatic mono- and polycarboxylic acids and their metal salts, anhydrides, and esters; phenol derivatives such as bisphenol; urea derivatives; metal-containing salicylic acid-type compounds; metal-containing naphthoic acid-type compounds; boron compounds; quaternary ammonium salts; calixarene; and resin-type charge control agents.

The positive-charging charge control agents can be exemplified by the following: nigrosine and nigrosine modifications by, for example, a fatty acid metal salt; guanidine compounds; imidazole compounds; quaternary ammonium salts such as tributylbenzylammonium 1-hydroxy-4-naphthosulfonate salt and tetrabutylammonium tetrafluoroborate, and the onium salts, such as phosphonium salts, that are analogues of the preceding, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-type charge control agents.

A single one of the preceding may be used or combinations of two or more may be used.

Among the preceding, metal-containing salicylic acid-type compounds are preferred for the charge control agent other than the resin-type charge control agents, and metal-containing salicylic acid-type compounds in which the metal is aluminum or zirconium are particularly preferred. An aluminum salicylate compound is a particularly preferred control agent.

A polymer or copolymer that has a sulfonic acid group, sulfonate salt group, or sulfonate ester group, a salicylic acid segment, or a benzoic acid segment is preferably used for the resin-type charge control agent. The preferred amount of charge control agent incorporation, expressed per 100.0 mass parts of the polymerizable monomer, is at least 0.01 mass parts and not more than 20.0 mass parts and is more preferably at least 0.05 mass parts and not more than 10.0 mass parts.

The weight-average particle diameter (D4) of the toner produced by the present invention is preferably at least 3.0 μm and not more than 12.0 μm and is more preferably at least 4.0 μm and not more than 10.0 μm. When the weight-average particle diameter (D4) is at least 3.0 μm and not more than 12.0 μm, an excellent flowability is obtained and the latent image can be faithfully developed.

In the toner of the present invention, the crystalline polyester preferably forms a plurality of domains in the cross section of the toner as observed with a scanning transmission electron microscope (STEM). The number-average major axis length of these domains is preferably at least 50 nm and not more than 300 nm and is more preferably at lease 50 nm and not more than 250 nm. The number of domains in this toner cross section is preferably at least 8 and not more than 500 and is more preferably at least 10 and not more than 300.

The lamellae of the crystalline polyester can be observed by ruthenium staining of the toner cross section and STEM observation. A single form constituting this lamella is referred to as a domain. That is, preferably a plurality of relatively small crystalline polyester domains are formed in the toner in the present invention.

The state in which such domains are present in the interior of the toner is referred to as the "dispersion of the domains". When the melting point of the crystalline polyester is exceeded due to the heat input to the toner at the fixing unit, the domains dispersed in the interior of the toner undergo softening instantaneously, and, due to the dispersion of the domains, softening of the toner as a whole is facilitated and the fixing performance is substantially improved.

The number-average major axis length of these domains is preferably at least 50 nm and not more than 300 nm for the toner of the present invention. FIG. 1 is a schematic diagram of a domain of the crystalline polyester. By having the number-average diameter of the domains be in the indicated range, a large melt deformation by the toner occurs when the crystalline polyester undergoes instantaneous melting and the fixing performance can then be improved. The result is a facilitation of the development of the effect of suppressing back end offset.

When the number-average major axis length of the domains is at least 50 nm, the fixing performance can be improved and hot offset can be suppressed and a broad fixable temperature window is established. On the other hand, at not more than 300 nm, an excellent fixing performance is obtained and back end offset is readily suppressed. The number-average major axis length of the domains can be controlled, for example, through the type and content of the crystalline polyester and wax and by adjusting the cooling rate in the toner production process.

The number of domains in the toner cross section is preferably at least 8 and not more than 500 in the toner of the present invention. When this number of domains is not more than 500, the fixing performance is improved and back end offset is suppressed and at the same time hot offset can be suppressed and a broad fixable temperature window can be established. On the other hand, at 8 and above, an excellent fixing performance is assumed and back end offset is readily suppressed. The number of domains in the toner cross section can be controlled, for example, through the type and content of the crystalline polyester and wax and by adjusting the cooling rate in the toner production process.

The use in the ester wax of any of an ester compound of a dihydric alcohol and an aliphatic monocarboxylic acid, and an ester compound of a dibasic carboxylic acid and an aliphatic monoalcohol is preferred. Such a difunctional ester wax readily acts as a nucleating agent for the crystalline polyester in the suspension polymerization method, which is preferred for use in the present invention. As a result, the crystallization of crystalline polyester domains in the toner interior is readily brought about and control of these domains into the desired ranges is facilitated. Specifically, control into the relatively narrow range of at least 50 nm and not more than 300 nm for the number-average major axis length of the crystalline polyester domains is facilitated, and control of the number of domains into the relatively broad range of at least 8 and not more than 500 is also facilitated.

The toner of the present invention can be produced by any known method. Considering first the case of production by a pulverization method, for example, the binder resin, colorant, wax, and crystalline polyester and, depending on the case, components required for a toner such as a charge control agent as well as other additives are thoroughly mixed using a mixing device such as a Henschel mixer or a ball mill. After this, the toner particles can be obtained by carrying out melt-kneading using a hot kneading device such as a hot roll, kneader, or extruder to disperse or dissolve the toner materials followed by cooling and solidification, pulverization, then classification, and as necessary a surface treatment. Either of the classification and surface treatment may be carried out before the other. A multigrade classifier is preferably used in the classification step based on a consideration of the production efficiency.

The pulverization step can be carried out by a method that uses a known pulverizing apparatus, e.g., a mechanical impact system or a jet system. In addition, pulverization may be carried out with the additional application of heat and/or a process may be carried out in which mechanical impact is applied on an auxiliary basis. In addition, a hot water bath procedure may be used in which the microfinely pulverized (and possibly classified) toner particles are dispersed in hot water, and passage through a hot gas current may be used.

The means for applying a mechanical impact force can be exemplified by methods that use a mechanical impact-based pulverizing device, e.g., a Kryptron System from Kawasaki Heavy Industries, Ltd. or a Turbo Mill from Turbo Kogyo Co., Ltd. An apparatus such as a Mechanofusion System from Hosokawa Micron Group or a Hybridization System from NARA MACHINERY CO., LTD. can also be used. These devices use methods that press the toner by centrifugal force to the inside of a casing using blades rotating at high speed, to thereby apply a mechanical impact force to the toner by a force such as, for example, a compressive force, a frictional force, and so forth.

While the toner of the present invention can be produced by a pulverization method as described in the preceding, toner production in an aqueous medium is preferred from the standpoint of controlling the state of occurrence of the crystalline substances, e.g., the crystalline polyester and wax. In particular, the suspension polymerization method is preferred because it facilitates creating a microdisperse state for the crystalline polyester and because it facilitates control with regard to the promotion of crystallization.

The suspension polymerization method is described in the following.

In the suspension polymerization method, the polymerizable monomer that will form the binder resin, the wax, the crystalline polyester, and the colorant (and optionally a polymerization initiator, crosslinking agent, charge control agent, and other additives) are dissolved or dispersed uniformly to obtain a polymerizable monomer composition. Then, this polymerizable monomer composition is dispersed using a suitable stirring device in a continuous phase (for example, an aqueous phase) that contains a dispersing agent while a polymerization reaction is run at the same time, to thereby obtain a toner having a desired particle diameter. The toner obtained by this suspension polymerization method (also referred to hereafter as "polymerized toner") can be expected to provide an enhanced image quality because the shape of the individual toner particles is uniformly approximately spherical and because the distribution of the amount of charge is also relatively uniform.

The polymerizable monomer constituting the polymerizable monomer composition can be exemplified as follows.

The polymerizable monomer can be exemplified by the styrenic polymerizable monomers described above; the acrylic polymerizable monomers and methacrylic polymerizable monomers described above; and also by monomers such as acrylonitrile, methacrylonitrile, and acrylamide. A single one of these monomers can be used or a mixture can be used. Among these monomers, the use of styrene by itself or mixed with other monomer is preferred from the standpoint of the developing characteristics and the durability of the toner.

The polymerization initiator is preferably a polymerization initiator that has a half-life in the polymerization reaction of 0.5 to 30 hours. In addition, when the polymerization reaction is run using an amount of addition that is 0.5 to 20 mass parts per 100 mass parts of the polymerizable monomer, a polymer can be obtained that has a molecular weight maximum between 5,000 and 50,000 and a desirable strength and favorable melt properties can then be imparted to the toner.

Specific polymerization initiators can be by the following: azo and diazo polymerization initiators such 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, and t-butyl peroxypivalate.

A crosslinking agent may be added when the toner of the present invention is produced by a polymerization method, and a preferred amount of addition for this is 0.001 to 15 mass parts per 100 mass parts of the polymerizable monomer.

Primarily compounds having at least two polymerizable double bonds are used as this crosslinking agent. For example, an aromatic divinyl compound such as divinylbenzene or divinylnaphthalene; a carboxylate ester having two double bonds such as, for example, ethylene glycol diacrylate, ethylene glycol dimethacrylate, or 1,3-butanediol dimethacrylate; a divinyl compound such as divinylaniline, divinyl ether, divinyl sulfide, or divinyl sulfone; or a compound having three or more vinyl groups may be used, either individually or as a mixture of two or more species.

In methods of producing the toner of the present invention by polymerization, generally a toner composition as described above and so forth is added as appropriate and is dissolved or dispersed to uniformity with a disperser, e.g., a homogenizer, ball mill, or ultrasound disperser, to give a polymerizable monomer composition and this polymerizable monomer composition is suspended in an aqueous medium that contains a dispersing agent. At this point, the particle diameter of the obtained toner particles is sharpened by establishing the desired toner particle size all at once using a high-speed disperser such as a high-speed stirrer or an ultrasound disperser. With regard to the time point for addition of the polymerization initiator, it may be added at the same time as the addition of the other additives to the polymerizable monomer or it may be mixed immediately before suspension in the aqueous medium. In addition, the polymerization initiator dissolved in the polymerizable monomer or solvent may also be added immediately after granulation and prior to the initiation of the polymerization.

After granulation, stirring should be carried out, using an ordinary stirrer, to a degree that maintains the particulate condition and prevents particle flotation or sedimentation.

A known surfactant or organic dispersing agent/inorganic dispersing agent can be used as a dispersing agent in the production of the toner of the present invention. Among these, inorganic dispersing agents are preferred because they resist the production of toxic ultrafine dust; they achieve dispersion stability through steric hindrance and because of this resist disruptions in the stability even when changes in the reaction temperature occur; and they are easily washed out and thus tend to avoid having negative effects on the toner. These inorganic dispersing agents can be exemplified by multivalent metal salts of phosphoric acid, such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

These inorganic dispersing agents are preferably used at 0.2 to 20 mass parts per 100 mass parts of the polymerizable monomer. In addition, a single one of these dispersing agents may be used by itself or a plurality may be used in combination. 0.001 to 0.1 mass parts of a surfactant may also be co-used.

When these inorganic dispersing agents are used, they may be used as such or, in order to obtain even finer particles, they may be used by producing particles of the inorganic dispersing agent in the aqueous medium. For example, in the case of tricalcium phosphate, water-insoluble calcium phosphate can be produced by mixing an aqueous sodium phosphate solution with an aqueous calcium chloride solution under high-speed stirring, and a more uniform fine dispersion is then made possible, Here, water-soluble sodium chloride is produced as a by-product at the same time, but the presence of the water-soluble salt in the aqueous medium is even more favorable because this inhibits the dissolution of the polymerizable monomer in the water and suppresses the production of ultra fine toner particles by emulsion polymerization.

The surfactant can be exemplified by sodium dodecylbenzene sulfate, sodium tetradecyl sulfate, sodium pentadecyl sulfate, sodium octyl sulfate, sodium oleate, sodium laurate, sodium stearate, and potassium stearate.

The polymerization temperature in the step of polymerizing the polymerizable monomer is set to at least 40° C. and generally to a temperature from 50° C. to 90° C. When the polymerization is carried out in this temperature range, the ester wax which is to be sealed in the interior undergoes precipitation by phase separation and its encapsulation is thus facilitated.

Once the polymerization of the polymerizable monomer has been completed and colored particles have been obtained, the colored particles may be heated, while dispersed in the aqueous medium, to a temperature that exceeds the melting points of the crystalline polyester and release agent. This process is not necessary when the polymerization temperature exceeds these melting points.

The range preferred for the present invention for the cooling rate in the ensuing cooling step will be considered for toner production methods as a whole and not just for polymerization methods.

The focus here is on toner production methods with the objective or bringing about the crystallization of the crystalline substances and particularly the crystalline polyester.

For toner production by, for example, the pulverization method, suspension polymerization, or emulsion polymerization, a step is preferably included in which heating is once performed to a temperature at which the crystalline polyester and wax temporarily melt followed by cooling to normal temperature. Considering this cooling step, as the temperature declines, molecular motion in the crystalline polyester, which has been liquefied by the increase in temperature, becomes less active and crystallization begins when the neighborhood of the crystallization temperature is reached. Crystallization progresses with additional cooling and complete solidification occurs at normal temperature. Investigations by the present inventors demonstrated that the degree of crystallinity of the crystalline substance varied with the cooling rate.

Specifically, an increasing trend for the degree of crystallinity of the contained crystalline substance occurred when cooling was carried out at at least 5.0° C./min from a temperature high enough for the crystalline polyester and wax to melt (for example, 100° C.), to at or below the glass transition temperature of the toner. While the details are unclear, it is thought that, by establishing such cooling conditions, the crystallization of the crystalline material having its crystallization peak on the higher temperature side is restrained and the crystal nuclei for the crystalline substance that has its crystallization peak on the lower temperature side can be increased.

A crystalline polyester that readily assumes a high degree of crystallinity is preferably used in the present invention for the crystalline substance having its crystallization peak on the lower temperature side. That is, when this is done, by controlling the cooling rate, the degree of crystallinity of the crystalline polyester can be increased by means of the separate crystalline substance having its crystallization peak on the higher temperature side.

More specifically, the condition of a sufficiently rapid cooling rate is, as described above, the case of cooling at a rate sufficiently faster than 5.0° C./min, for example, at approximately at least 20.0° C./min and not more than 50.0° C./min. Conversely, the condition of a sufficiently slow cooling rate is the case of cooling at a rate sufficiently slower than 5.0° C./min, for example, at approximately at least 0.5° C./min and not more than 2.0° C./min. In the present invention, the cooling rate is preferably at least 20.0° C./min and not more than 50.0° C./min.

After completion of the polymerization of the polymerizable monomer composition, an annealing treatment at a temperature in the vicinity of ±3° C. of the crystallization peak temperature of the crystalline substance is preferably also carried out from the standpoint of increasing the degree of crystallinity of the crystalline substance. The preferred range for the holding time is at least 100 minutes and not more than 300 minutes.

The degree of crystallinity of the crystalline substance is readily increased by holding for a time sufficiently longer than 100 minutes, and this is thus preferred. On the other hand, when extremely shorter than 100 minutes (for example, less than 30 minutes), the degree of crystallinity of the crystalline substance may not be adequately raised.

The toner particle is obtained by subjecting the obtained polymer particle to filtration, washing, and drying by known methods. The toner of the present invention can be obtained by as necessary mixing this toner particle with an inorganic fine powder, infra, to attach same to the surface of the toner particle. The course powder and fines present in the toner particle can also be fractionated off by the introduction into the production process of a classification step (prior to mixing with the inorganic fine powder).

The toner of the present invention may also be a toner for which additives such as a fluidizing agent have as necessary been mixed with the toner particle obtained by the production method as described above. A known procedure can be used for the mixing method; for example, the Henschel mixer is an apparatus that can be advantageously used.

An inorganic fine powder having a number-average primary particle diameter of preferably 4 to 80 nm and more preferably 6 to 40 nm is preferably added to the toner particle as a fluidizing agent in the toner of the present invention. The inorganic fine powder is added in order to improve toner fluidity and establish charge uniformity on the toner particle; however, functions such as adjusting the amount of charge on the toner and improving the environmental stability are preferably also imparted by a treatment such as carrying out a hydrophobic treatment on the inorganic fine powder. The number-average primary particle diameter of the inorganic fine powder can be measured by a method that uses a magnified photograph of the toner, taken with a scanning electron microscope.

For example, silica, titanium oxide, alumina, and so forth can be used for the inorganic fine powder used in the present invention. For example, a so-called dry silica or a dry silica known as fumed silica produced by the vapor-phase oxidation of a silicon halide and a so-called wet silica produced from, e.g., water glass, can both be used as the silica fine powder. However, dry silica—which presents little silanol group at the surface or in the interior of the silica fine powder and which contains little residue from production, e.g., $Na_2O$, $SO_3^{2-}$, etc.—is preferred. For example, by using another metal halide compound, e.g., aluminum chloride or titanium chloride, in the production process along with the silicon halide compound, it is also possible to obtain a composite fine powder of silica and another metal oxide, and these composite fine powders are also encompassed by dry silica.

The amount of addition of the inorganic fine powder having a number-average primary particle diameter of 4 to 80 nm is preferably at least 0.1 mass parts and not more than 3.0 mass parts per 100 mass parts of the toner particle. When the amount of addition is at least 0.1 mass parts, the effects therefrom are satisfactorily obtained; the developing performance is excellent at not more than 3.0 mass parts. The content of the inorganic fine powder can be determined using x-ray fluorescence analysis using a calibration curve constructed from standard materials.

The inorganic fine powder is preferably a hydrophobically treated substance in the present invention because this can bring about an improvement in the environmental stability of the toner. When the inorganic fine powder added to the toner absorbs moisture, the amount of charge on the toner particle undergoes a substantial decline and the amount of charge readily becomes nonuniform and toner scattering readily occurs. A single treatment agent, e.g., silicone varnish, various modified silicone varnishes, silicone oil, various modified silicone oils, silane compounds, silane coupling agents, other organosilicon compounds, organotitanium compounds, and so forth, or combinations of two or more may be used as the treatment agent used in the hydrophobic treatment of the inorganic fine powder.

Other additives may also be used in the toner of the present invention in small amounts within a range that substantially does not exercise a negative effect, for example, lubricant powders such as a fluororesin powder, zinc stearate powder, polyvinylidene fluoride powder, and so forth; abrasives such as cerium oxide powder, silicon carbide powder, strontium titante powder, and so forth; flowability-imparting agents such as, for example, titanium oxide powder, aluminum oxide powder, and so forth; anti-caking agents; and a reverse-polarity organic fine powder or inorganic fine powder as a development performance improving agent. These additives may also be used after carrying out a surface hydrophobic treatment thereon.

Figure 2:
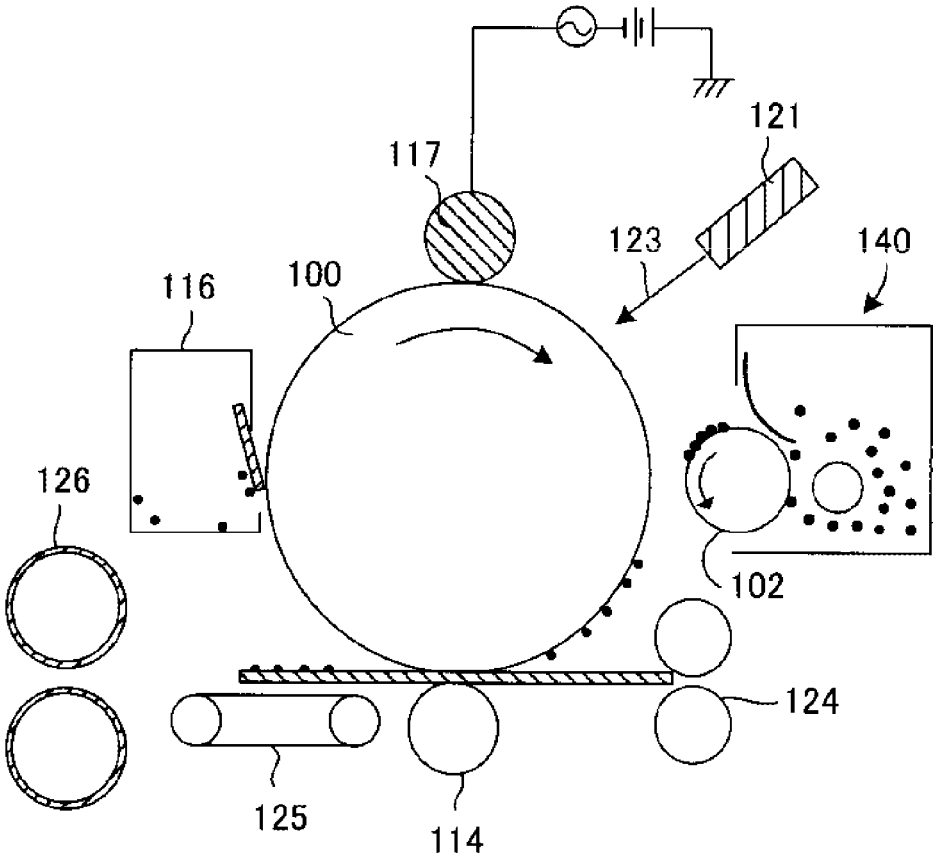
FIG. 2 is a schematic diagram that shows an example of an image-forming apparatus.

An example of an image-forming apparatus that can advantageously use the toner of the present invention will be specifically described in accordance with FIG. 2. In FIG. 2, 100 is a photosensitive drum, and, for example, the following are disposed at its circumference: a primary charging roller 117, a developing device 140 having a developing sleeve 102, a transfer charging roller 114, a cleaner 116, and a register roller 124. The photosensitive drum 100 is charged to, for example, −600 V (the applied voltage is, for example, an AC voltage of 1.85 kVpp or a DC voltage of −620 Vdc), by the primary charging roller 117. Photoexposure is carried out by irradiating the photosensitive drum 100 with laser light 123 from a laser generator 121, and an electrostatic latent image that corresponds to the target image is thereby formed. The electrostatic latent image on the photosensitive drum 100 is developed by a single-component toner by the developing device 140 to obtain a toner image, and the toner image is transferred onto a transfer material by the transfer charging roller 114, which contacts the photosensitive drum with the transfer material interposed therebetween. The transfer material bearing the toner image is moved to the fixing unit 126 by, for example, a transport belt 125, and fixing onto the transfer material is carried out. In addition, the toner remaining on the photosensitive drum in part is cleaned off by the cleaner 116.

An image-forming apparatus that uses magnetic single-component jumping development is illustrated here, but this may be an image-forming apparatus used in either a jumping development method or a contact development method.

The methods of measuring the various properties pertinent to the toner of the present invention are described in the following.

<Measurement of the Crystallization Peak Temperature Originating from the Crystalline Substances in the Toner>

First, the crystallization peaks can be determined for the pure crystalline polyester and pure wax, and the description will thus begin with these procedures.

A differential scanning calorimeter (DSC), for example, a DSC-7 from PerkinElmer Co., Ltd., a DSC2920 from TA Instruments, or a Q1000 from TA Instruments, can be used for the peak temperature and exothermic curve for the crystalline polyester and the wax. Temperature correction in the instrument detection section uses the melting points of indium and zinc, and correction of the amount of heat uses the heat of fusion of indium. An aluminum pan is used for the measurement sample, and measurement is carried out with the installation of an empty pan for reference. 100 mg of the crystalline polyester or the wax is exactly weighed out and is placed in the pan. The measurement conditions are as follows.

measurement mode: standard ramp up condition: heating from 20° C. to 100° C. at 10° C./min ramp down condition: cooling from 100° C. to 20° C. at 0.5/min A temperature-heat flow curve is constructed based on the obtained results, and the exothermic curve for the crystalline polyester and the exothermic curve for the wax are obtained from the results during cooling. The top of the exothermal peak in the exothermal curve is taken to be the crystallization peak temperature Tp (° C.) or Tw (° C.).

The crystallization peak temperature and exothermal curve for the crystalline polyester and the wax can also be obtained from the toner. In the procedure for this, the crystalline polyester and wax are isolated from the toner by the previously described method using tetrahydrofuran and each are then analyzed by DSC.

Proceeding in this manner provides values that are the same as the Tp (° C.) and Tw (° C.) cited above.

In addition, 4 mg of the toner is exactly weighed out and measurement is carried out using the same conditions as above. That is, after heating to 100° C., the first DSC curve is obtained while cooling at 0.5° C./min. It is confirmed that a peak top is present for at: least two crystallization peaks in a temperature range from 40° C. to 80° C. in this first DSC curve. Of these crystallization; peaks, ΔH(0.5) is assigned to the exothermic quantity (J/g) for the crystallization peak residing at the lowest temperature side.

4 mg of the toner is again exactly weighed out and a second DSC curve is obtained proceeding using the same measurement conditions as above with the exception that the ramp down condition is cooling from 100° C. to 20° C. at 100° C./min. Of the peaks present in this second DSC curve in a temperature range from 40° C. to 80° C., ΔH(100) is assigned to the exothermic quantity (J/g) for the crystallization peak residing at the lowest temperature side. With regard to the exothermic quantities ΔH(0.5) and ΔH(100) for the crystallization peaks, in those instances in which the base of either crystallization peak is also present at below 40° C. or above 80° C., the calculations are performed by also adding the base of the crystallization peak present at below 40° C. or above 80° C. to the exothermic quantity for the crystallization peak.

<The Melting Point of the Wax>

The melting point of the wax can be determined in measurement by DSC as the peak top temperature of the endothermic peak. The measurement is carried out in accordance with ASTM D 3417-99. For example, a DSC-7 from PerkinElmer Co., Ltd., a DSC2920 from TA Instruments, or a Q1000 from TA instruments can be used for this measurement. Temperature correction in the instrument detection section uses the melting points of indium and zinc, and correction of the amount of heat uses the heat of fusion of indium. An aluminum pan is used for the measurement sample, and measurement is carried out with the installation of an empty pan for reference.

<Measurement of the Weight-Average Particle Diameter (D4) and Number-Average Particle Diameter (D1) of the Toner (Particle)>

The weight-average particle diameter (D4) and the number-average particle diameter (D1) of the toner (particle) are determined—by measuring in 25,000 channels for the number of effective measurement channels and analyzing the measurement data—using a "Coulter Counter Multisizer 3"

(registered trademark, from Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (from Beckman Coulter, Inc.), for setting the measurement conditions and analyzing the measurement data.

The aqueous electrolyte solution used for the measurements is prepared by dissolving special-grade sodium chloride in ion-exchanged water to provide a concentration of approximately 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the threshold value/noise level measurement button. In addition, the current is set to 1,600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical industries, Ltd.).

(3) A prescribed amount of ion-exchanged water is introduced into the water tank of an "Ultrasonic Dispersion System Tetora 150" (Nikkaki Bios Co., Ltd.), an ultrasound disperser with an electrical output of 120 W equipped with two oscillators (oscillation frequency=50 kHz) disposed such that the phases are displaced by 180°. Approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner (particle) is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner (particle)-containing aqueous electrolyte solution prepared in (5) is dripped into the roundbottom beaker set in the sample stand as described in (1) with adjustment to provide a measurement concentration of approximately 5%. Measurement is then performed until the number: of measured particles reaches 50,000.

(7) The number-average particle diameter (D4) is determined by analyzing the measurement data with the previously cited dedicated software provided with the instrument. When set to graph/volume % with the dedicated software, the "average diameter" on the analysis/volumetric statistical value (arithmetic average) screen is the weight-average particle diameter (D4). When set to graph/number % with the dedicated software, the "average diameter" on the "analysis/numerical statistical value (arithmetic average)" screen is the number-average particle diameter (D1).

<Measurement of the Molecular Weight and Composition Distribution of the Ester Wax>

The composition distribution of the ester wax is obtained by first measuring the molecular weight distribution by GPC and then measuring this region by gas chromatography (GC) or MALDI TOP MASS. The GPC of the ester wax is measured under the following conditions.

(GPC Measurement Conditions)

Column: 2×GMH-HT30cm (TOSOH CORPORATION)

Temperature: 135° C.

Solvent: o-dichlorobenzene (0.1% Ionol added)

Flow rate: 1.0 mL/min

Sample: injection of 0.4 mL of the 0.15% sample

The measurements are conducted under the conditions given above, and a molecular weight calibration curve constructed using monodisperse polystyrene standard samples is used for the determination of the sample molecular weight. Moreover, calculation as polyethylene is performed using a conversion formula derived from the Mark-Houwink viscosity equation.

The peaks yielded by GPC are analyzed and the maximum value and minimum value of the molecular weight distribution for the ester wax are calculated. During the analysis by GC and MALDI TOFF MASS as described below, the region sandwiched between the maximum value and minimum value yielded by GPC is regarded as the "range of the molecular weight distribution of the ester wax". While the ester wax of the present invention can be measured by either GC or MALDI TOF MASS, MALDI TOF MASS is suitably selected when volatilization is problematic and GC is suitably selected when a peak overlaps with the matrix. Both measurement methods are described.

(GC Measurement Conditions)

The specific conditions for measurement of the composition distribution of the ester wax using gas chromatography (GC) are described here. A GC-17A (Shimadzu Corporation) is used for the gas chromatography (GC). 10 mg of the sample is added to 1 mL of toluene and heating and dissolution are carried out for 20 minutes in an 80° C. thermostat. 1 μL of this solution is injected into the GC instrument equipped with an on-column injector. The column used is a 0.5 mm diameter×10 m length Ultra Alloy-1 (HT). The column is initially heated from 40° C. to 200° C. at a ramp speed of 40° C./min; is then heated to 350° C. at 15° C./min; and is then heated to 450° C. at a ramp speed of 7° C./min. He gas is supplied as the carrier gas at a pressure condition of 50 kPa.

The peak group contained in the aforementioned "range of the molecular weight distribution of the ester wax" is elucidated by introducing the volatilized component into the mass spectrometer (mass analyzer) and obtaining the molecular weights of the multiple peaks obtained by GC. This peak group is analyzed and the sum of the peak areas is calculated. In addition, the peak having the largest peak area of the peaks obtained by GC is designated as the peak originating from the component having the highest content in the ester wax, and the proportion of this highest-content component in the composition distribution of the ester wax is obtained, by obtaining the peak area ratio for the highest-content component with respect to the sum of all the peak areas.

Compound identification can be performed by separately injecting ester waxes of known structure and comparing the same elution times with each other or by introducing the volatilized component into the mass spectrometer and carrying out spectrum analysis.

(Measurement Conditions for MALDI TOF MASS)

Measurement of the composition distribution of the ester wax by MALDI TOF MASS is described in the following.

With regard to matrix selection, an optimal matrix was selected in accordance with the analyte species and consideration was given to avoid overlap between the peaks from the matrix and the peaks from the analyte.

Of the peaks obtained by MALDI TOF MASS, the peaks contained in the aforementioned, "range of the molecular weight distribution of the ester wax" are elucidated and the sum of the individual peak intensities is calculated. Among these peaks, the peak with the greatest intensity is taken to be the peak originating from the highest-content component. The proportion of the highest-content component in the composition distribution of the ester was is calculated as the ratio of the peak intensity originating from the highest-content component to the sum of the peak intensities.

Compound identification can be carried out by analysis of the spectra obtained by MALDI TOF MASS for separate ester waxes of known structure.

<Method for Measuring the Molecular Weight of the Crystalline Polyester, Amorphous Saturated Polyester Resin, and Toner>

The molecular weight of the crystalline polyester, amorphous saturated polyester resin, and toner are measured by gel permeation chromatography (GPC) as follows.

First, the crystalline polyester or toner is dissolved in tetrahydrofuran (THF) at room temperature. The obtained solution is filtered across a "Sample Pretreatment Cartridge" solvent-resistant membrane filter with a pore diameter of 0.2 μm (from TOSOH CORPORATION) to obtain the sample solution. The sample solution is adjusted to provide a THF-soluble component concentration of 0.8 mass %. The measurement is performed under the following conditions using this sample solution.

Instrument: "HLC-8220GPC" high-performance GPC instrument (from TOSOH CORPORATION)
Column: 2×LF-604
Eluent: THF
Flow rate: 0.6 mL/min
Oven temperature: 40° C.
Sample injection amount: 0.020 mL The molecular weight of the sample is determined using a molecular weight calibration curve constructed using polystyrene resin standards (for example, product name: "TSK Standard Polystyrene F-850, F-450, F-288, F-128, F-80, F40, F20, F-10, F-4, F-2, F-1, A-5000, A-2500, A-1000, and A-500", from TOSOH CORPORATION).

<Method for Measuring the Acid Value of the Crystalline Polyester>

The acid value of the crystalline polyester in the present invention is determined using the following procedure.

The acid value is the number of milligrams of potassium hydroxide required to neutralize the acid present in 1 g of a sample. The acid value of polar resins was measured based on JIS K 0070-1992. In specific terms the measurement was performed according to the following procedure.

(1) Reagent Preparation

A phenolphthalein solution was obtained by dissolving 1.0 g of phenolphthalein in 90 mL of ethyl alcohol (93 volume %) and bringing to 100 mL by adding ion-exchanged water.

7 g of special-grade potassium hydroxide was dissolved in 5 mL of water and this was brought to 1 L by the addition of ethyl alcohol (95 volume %). This was introduced into an alkali-resistant container avoiding contact with, for example, carbon dioxide, and allowed to stand for 3 days. Standing was followed by filtration to obtain a potassium hydroxide solution. The obtained potassium hydroxide solution was stored in an alkali-resistant container. The factor for this potassium hydroxide solution was determined from the amount of the potassium hydroxide solution required for neutralization when 25 mL of 0.1 mol/L hydrochloric acid was introduced into an Erlenmeyer flask, several drops of the aforementioned phenolphthalein solution were added, and titration was performed using the potassium hydroxide solution. The 0.1 mol/L hydrochloric acid was prepared in accordance with JIS K 8001-1998.

(2) Procedure (A) Main Test 2.0 g of a crushed crystalline polyester sample was exactly weighed into a 200-mL Erlenmeyer flask and 100 mL of a toluene:ethanol (2:1) mixed solution was added and dissolution of the sample was carried out over 5 hours. Several drops of the aforementioned phenolphthalein solution were then added as an indicator and titration was performed using the aforementioned potassium hydroxide solution. The titration endpoint was taken to be persistence of the faint pink color of the indicator for approximately 30 seconds.

(B) Blank Test

The same titration as in the above procedure was run, but without using the sample (that is, with only the toluene: ethanol (2:1) mixed solution).

(3) The acid value was calculated by substituting the obtained results into the following formula.

$$A=[(C-B)\times f\times 5.61]/S$$

Here, A: acid value (mg KOH/g), B: amount (mL) of addition of the potassium hydroxide solution in the blank test, C: amount (mL) of addition of the potassium hydroxide solution in the main test, f: factor for the potassium hydroxide solution, S: sample (g).

<Method for Measuring the Glass Transition Temperature of the Amorphous Saturated Polyester Resin and Toner>

The glass transition temperature (Tg) of the amorphous saturated polyester resin and toner is measured according to ASTM D 3418-82 using a "Q1000" differential scanning calorimeter (TA Instruments).

Temperature correction in the instrument detection section is carried, out using the melting points of indium and zinc, and correction of the amount of is carried out using the heat of fusion of indium.

Specifically, 3.0 mg of the amorphous saturated polyester resin or toner is precisely weighed out as the measurement sample.

This is introduced into an aluminum pan and, using an empty aluminum pan for reference, the measurement is carried out under normal temperature and normal humidity at a ramp rate of 10° C./min in the measurement temperature range between 30° C. and 200° C.

The change in the specific heat in the temperature range of 40° C. to 100° C. is obtained during this heating process. The glass transition temperature (Tg) is taken to be the point at the intersection between the differential heat curve and the line for the midpoint of the baselines for prior to and subsequent to the appearance of the change in the specific heat.

<Method for Observing the Ruthenium-stained Toner Cross Section with a Scanning Transmission Electron Microscope (STEM)>

Observation of the cross section of the toner with a scanning transmission electron microscope (STEM) can be performed as follows.

The toner of the present invention is observed by carrying out ruthenium staining of the toner cross section. The crystalline resin present in the toner or the present invention is more easily stained by ruthenium than is the amorphous resin, such as the binder resin, and due to this a clear contrast is obtained and observation is easily performed. The amount of the ruthenium atom changes as a function of the strength/weakness of staining, and as a result these atoms are present in large amounts in a strongly stained region and transmission of the electron beam then does not occur and black appears in the observed image. The electron beam is readily transmitted in weakly stained regions, which then appear in white on the observed image.

First, the toner is dispersed onto a cover glass (Matsunami Glass Ind., Ltd., Square Cover Glass No. 1) so as to provide a single layer, and an Os film (5 nm) and a naphthalene film (20 nm) are formed as protective films using an osmium plasma coater (OPC80T, Filgen, Inc.). Then, D800 photocurable resin (JEOL Ltd.) is filled info a PTFE tube (1.5 mmØ×3 mmØ×3 mm) and the cover glass is gently placed over the tube oriented so the toner is in contact with the D800 photocurable resin. Exposure to light is carried out while in this configuration and the resin is cured, after which the cover glass is removed from the tube to give a cylindrical resin having the toner embedded in the surfacemost layer. Using an ultrasound ultramicrotome (UC7, Leica Camera AG), the toner cross section is exposed by making slices of just the length of the radius of the toner (4.0 μm) when the weight-average particle diameter (D4) is 8.0 μm) from the surfacemost face of the cylindrical resin at a slicing rate of 0.6 mm/s. Slicing is then carried out at a film thickness of 250 nm to produce a thin-slice sample of the toner cross section. A cross section of the central region of the toner can be obtained by executing slicing in accordance with this procedure.

Using a vacuum electronic staining device (VSC4R1H, Filgen, Inc.), the obtained thin-slice samples were stained for 15 minutes in a 500 Pa $RuO_4$ gas atmosphere, and STEM observation was carried out using a scanning transmission electron microscope (JEM2800, JEOL Ltd.).

Image acquisition was carried out at a STEM probe size of 1 nm and an image size of 1,024×1,024 pixels. Image acquisition was performed with the Contrast adjusted to 1,425 and the Brightness adjusted to 3,750 on the Detector Control panel for the bright-field image and with the Contrast adjusted to 0.0, the Brightness adjusted to 0.5, and the Gamma adjusted to 1.00 on the Image Control panel.

<Identification of the Domains of the Crystalline Polyester and Release Agent>

The domains of the crystalline polyester and the release agent are identified using the following procedure based on the STEM images of the toner cross section.

When the crystalline polyester and release agent can be acquired as raw materials, their crystalline structure is observed proceeding as in the previously described method for observing the ruthenium-stained toner cross section with a scanning transmission electron microscope (STEM), and an image of the lamellar structure of the crystals of each raw material is obtained. These are compared with the lamellar structure of the domains in the toner cross section, and the raw material forming the domains in the toner cross section can be identified when the error on the interlayer spacing of the lamellae is not more than 10%.

<Measurement of the Number-Average Major Axis Length of the Crystalline Polyester Resin Domains>

In the present invention, the number-average diameter of the crystalline polyester resin domains denotes the number-average diameter determined based on the STEM image from the major axis lengths of the crystalline polyester resin domains.

The number-average major axis length of the crystalline polyester resin domains is measured based on the STEM image obtained by observation of the ruthenium-stained toner cross section with a scanning transmission electron microscope (STEM). 100 toner cross sections are observed at this time. All the domains are measured and the number-average diameter is calculated. The obtained number-average diameter is designated the number-average major axis length of the crystalline polyester resin domains.

<Measurement of the Number of Crystalline Polyester Resin Domains>

The number of crystalline polyester domains contained per toner cross section is measured proceeding in the same manner as in the previously described measurement of the number-average major axis length of the crystalline polyester domains. This is carried out on 100 toner cross sections, and the number of domains per one-toner cross section is designated as the number of crystalline polyester domains.

EXAMPLES

The present invention is more specifically described in the following using production examples and examples, but these in no way limit the present invention. The number of parts in the following blends indicates mass parts in the absence of a specific designation.

Examples of the production of the ester wax are described in the following. The ester waxes were obtained in the present invention by producing ester compounds and melt mixing these at the prescribed blending ratios.

<Ester Compound Production Example>

300 mol parts of benzene, 200 mol parts of docosanol (behenyl alcohol) as the alcohol monomer, and 100 mol parts of decanedioic acid (sebacic acid) as the acid monomer were charged to a reactor fitted with a Dimroth condenser, Dean-Stark water separator, and thermometer. 10 mol parts of p-toluenesulfonic acid was also added and, after thorough stirring and dissolution, heating under reflux was carried out for 6 hours followed by opening the valve on the water separator and carrying out azeotropic distillation. After the azeotropic distillation, thorough washing was performed with sodium bicarbonate followed by drying and distillative removal of the benzene. The obtained product was recrystallized and then washed and purified to obtain an ester compound S-22.

Ester compounds were similarly obtained by changing the docosanol to a different alcohol in each case. S-20 was obtained by changing the docosanol to eicosanol; S-24 was obtained by changing to tetracosanol; S-16 was obtained by changing to 1-hexadecanol; and S-28 was obtained by changing to 1-octacosanol.

The H-20, H-22, and H-24 ester compounds given in Table 1 were obtained by changing the alcohol monomer and acid monomer as indicated in Table 1.

<Ester Wax 1 Production Example>

Ester wax 1 was obtained by melt mixing S-20, S-22, and S-24 in the proportions given in Table 2 and cooling followed by pulverization. The composition proportions measured by GC-MASS (including the content of the highest-content component in the ester wax) and the melting point of the ester wax are also given in Table 2.

<Ester Waxes 2-6 Production Example>

Ester waxes 2 to 6 were obtained by melt mixing ester compounds in the proportions given in Table 2 and cooling followed by pulverization. The composition proportions measured by GC-MASS and the melting points of the ester waxes are also given in Table 2.

TABLE 2

| | number of functional groups in the major component of the ester wax | starting materials for the ester wax | mixing proportions | composition proportions: composition proportions by GC-MASS | composition proportions: content of the highest-content component | melting point/° C. of the ester wax | presence/absence of a structure corresponding to formula (1) or (2) | x | y |
|---|---|---|---|---|---|---|---|---|---|
| ester wax 1 | 2 | S-20 | 15% | 15% | 70% | 73.0 | present: formula (2) | — | 8 |
| | | S-22 | 70% | 70% | | | | | |
| | | S-24 | 15% | 15% | | | | | |
| ester wax 2 | 2 | H-20 | 30% | 30% | 40% | 71.0 | present: formula (1) | 6 | — |
| | | H-22 | 40% | 40% | | | | | |
| | | H-24 | 30% | 30% | | | | | |
| ester wax 3 | 2 | S-20 | 10% | 10% | 80% | 74.0 | present: formula (2) | — | 8 |
| | | S-22 | 80% | 80% | | | | | |
| | | S-24 | 10% | 10% | | | | | |
| ester wax 4 | 2 | S-20 | 25% | 25% | 30% | 71.0 | present: formula (2) | — | 8 |
| | | S-22 | 30% | 30% | | | | | |
| | | S-24 | 25% | 25% | | | | | |
| | | S-16 | 10% | 10% | | | | | |
| | | S-28 | 10% | 10% | | | | | |
| ester wax 5 | 1 | B-22 | 70% | 70% | 100% | 74.0 | absent | — | — |
| ester wax 6 | 4 | P-22 | 20% | 20% | 80% | 72.0 | absent | — | — |
| | | P-18 | 80% | 80% | | | | | |

TABLE 1

| ester compound | alcohol monomer: name | alcohol monomer: number of carbons | acid monomer: name | acid monomer: number of carbons |
|---|---|---|---|---|
| S-20 | eicosanol | 20 | decanedioic acid | 10 |
| S-22 | docosanol (behenyl alcohol) | 22 | (sebacic acid) | |
| S-24 | tetracosanol | 24 | | |
| S-16 | 1-hexadecanol | 16 | | |
| S-28 | 1-octacosanol (montanyl alcohol | 26 | | |
| H-20 | 1,6-hexanediol | 6 | eicosanoic acid (arachidic acid) | 20 |
| H-22 | | | docosanoic acid (behenic acid) | 22 |
| H-24 | | | tetracosanoic acid | 24 |
| P-22 | pentaerythritol | 22 | docosanoic acid (behenic acid) | 22 |
| P-18 | | 18 | octadecanoic acid (stearic acid) | 18 |
| B-22 | docosanol (behenyl alcohol) | 22 | docosanoic acid (behenic acid) | 22 |

<Ester Wax 7>

A monofunctional ester compound (melting point=66° C.) from behenic acid and stearyl alcohol was used as ester wax 7.

<Ester Wax 8>

A hexafunctional ester compound (melting point=83° C.) from behenic acid and dipentaerythritol was used as ester wax 8.

<Ester Wax 9>

A hexafunctional ester compound (melting point=60° C.) from myristic acid and dipentaerythritol was used as ester wax 9.

<Paraffin Waxes 1 to 4>

The commercial paraffin waxes given in Table 3 were used.

TABLE 3

| designation | melting point/° C. | proportion for the highest-content component (%) |
|---|---|---|
| paraffin wax 1 | 75 | 100 |
| paraffin wax 2 | 68 | 100 |
| paraffin wax 3 | 50 | 100 |
| paraffin wax 4 | 86 | 100 |

<Production of Crystalline Polyester 1>

230.0 parts of sebacic acid as the carboxylic acid monomer and 242.1 parts of 1,10-decanediol as the alcohol monomer were charged to a reaction tank equipped with a nitrogen introduction line, a water separation line, a stirrer, and a thermocouple. While stirring, heating was carried out to 140° C. and a reaction was run for 8 hours while distilling out water under normal pressure and heating to 140° C. under a nitrogen atmosphere. Then, tin dioctylate was added at 1 part per 100 parts of the total monomer, and this was followed by reaction while heating to 200° C. at 10° C./hour. After 200° C. had been reacted, the reaction was run for 2 hours followed by reducing the pressure in the reaction tank to equal to or less than 5 kPa and reacting for 3 hours at 200° C. to obtain a crystalline polyester 1. The obtained crystalline polyester 1 had a weight-average molecular weight (Mw) of 20,100 and an acid value of 2.2 mg KOH/g.

<Crystalline Polyesters 2-7 Production Example>

Crystalline polyesters 2 to 7 were obtained proceeding as in Production of Crystalline Polyester 1, but changing the alcohol monomer and acid monomer as in Table 4 and adjusting the reaction time and temperature to provide the desired properties. The properties and structures of the obtained crystalline polyesters are given in Table 4.

TABLE 4

| | alcohol monomer | | acid monomer | | | | structure of the crystalline polyester | | | |
|---|---|---|---|---|---|---|---|---|---|---|
| crystalline polyester No. | monomer designation | amount of addition (mass parts) | monomer designation | amount of addition (mass parts) | Mw | acid value (mg KOH/g) | presence/ absence of structure corresponding to formula (1) or (2) | x | y | x + y |
| crystalline polyester 1 | 1,10-decanediol | 242.1 | decanedioic acid (sebaeic acid) | 230.0 | 20100 | 2.2 | present formula (1) and formula (2) | 10 | 8 | 16 |
| crystalline polyester 2 | 1,10-nonanediol | 202.4 | decanedioic acid (sebaeic acid) | 255.5 | 10000 | 5.0 | present formula (1) and formula (2) | 9 | 8 | 17 |
| crystalline polyester 3 | 1,6-hexanediol | 155.2 | 1,10-decanedicarboxylic acid (dodecanedicic acid) | 279.3 | 30000 | 2.1 | present formula (1) and formula (2) | 6 | 10 | 16 |
| crystalline polyester 4 | 1,12-dodecanediol | 281.1 | hexanedioic acid (adipic acid) | 166.2 | 20000 | 3.1 | present formula (1) and formula (2) | 12 | 4 | 16 |
| crystalline polyester 5 | 1,12-dodecanediol | 245.3 | butanedioic acid (succinic acid) | 155.2 | 39900 | 7.5 | present formula (1) | 12 | 2 | 14 |
| crystalline polyester 6 | diethylene glycol | 86.3 | decanedioic acid (sebacic acid) | 230.0 | 21000 | 2.2 | present formula (2) | 2 | 8 | 10 |
| crystalline polyester 7 | 1,4-butanediol | 125.2 | butanedioic acid (succinic acid) | 134.3 | 20100 | 3.5 | absent | 4 | 2 | 6 |

<Magnetic Iron Oxide Production Example>

55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were reslurried by redispersion in water. To this reslurry liquid was added sodium silicate to provide 0.20 mass % as silicon per 100 parts of the core particles; the pH of the slurry was adjusted to 6.0; and magnetic iron oxide particles having a silicon-rich surface were obtained by stirring. The obtained slurry was filtered and washed with a filter press and was reslurried with ion-exchanged water. Into this reslurry liquid (solids fraction=50 g/L) was introduced 500 g (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average diameter of 0.23 μm.

<Silane Compound Production Example>

30 parts of isobutyltrimethoxysilane was added dropwise to 70 parts of ion-exchanged water while stirring. While holding this aqueous solution at pH 5.5 and a temperature of 55° C., hydrolysis was then carried out by dispersing for 120 minutes using a dispersing impeller at a peripheral velocity of 0.46 m/s. This was followed by bringing the pH of the aqueous solution to 7.0 and cooling to 10° C. to stop the hydrolysis reaction. A silane compound-containing aqueous solution was obtained proceeding in this manner.

<Magnetic Body Production Example>

100 parts of the magnetic iron oxide was introduced into a high-speed mixer (Model LFS-2 from Fukae Powtec Corporation) and 8.0 parts of the silane compound-containing aqueous solution was added dropwise over 2 minutes while stirring at a rotation rate of 2,000 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a magnetic body.

<Colorant for Nonmagnetic Toner>

A commercial carbon black was used as the colorant for the nonmagnetic toner. The properties of the carbon black used were as follows: average primary particle diameter: 31 nm, DBP absorption: 40 mL/100 g, work function: 4.71 eV.

<Toner 1 Production Example>

An aqueous medium containing a dispersion stabilizer was obtained by introducing 450 parts of a 0.1 mol/L aqueous $Na_3PO_4$ solution into 720 parts of ion-exchanged water, heating to 60° C., and then adding 67.7 parts of a 1.0 mol/L aqueous $CaCl_2$ solution.

| | |
|---|---|
| styrene | 79.0 parts |
| n-butyl acrylate | 21.0 parts |
| divinylbenzene | 0.6 parts |
| metal complex of a monoazo dye (T-77, HODOGAYA CHEMICAL CO., LTD.) | 1.5 parts |
| magnetic body | 90.0 parts |
| amorphous saturated polyester resin | 5.0 parts |

(amorphous saturated polyester resin obtained by the condensation reaction of terephthalic acid with the 2 mol adduct of propylene oxide on bisphenol A; Mw=9,500, acid value=2.2 mg KOH/g, glass transition temperature=68° C.)

A monomer composition was obtained by mixing/dispersing the preceding formulation to uniformity using an attritor (Mitsui Miike Chemical Engineering Machinery Co., Ltd.). This monomer composition was heated to 63° C., and to it was added 10.0 parts of the crystalline polyester 1 described in Table 4 and 10.0 parts of the ester wax 1 described in Table 2 with mixing and dissolution.

This monomer composition was introduced into the aqueous medium described above and granulation was performed by stirring for 10 minutes at 12,000 rpm with a TK Homomixer (Tokushu Kika Kogyo Co., Ltd.) at 60° C. under an $N_2$ atmosphere. Then, while stirring with a paddle stirring blade, 9.0 parts of the polymerization initiator t-butyl peroxypivalate was introduced and heating to 70° C. was carried out and a reaction was run for 4 hours. After the completion of the reaction, the suspension was heated to 100° C. and was held for 2 hours.

In the cooling step following this, ice was introduced into the suspension to cool the suspension from 100° C. to 50° C. at 40° C./min; this was followed by spontaneous cooling to normal temperature. The dispersion stabilizer was subsequently dissolved by adding hydrochloric acid to the suspension and thoroughly washing, and filtration and drying then gave a toner particle 1. The glass transition temperature of toner particle 1 was 54° C. Toner particle 1 contained 100 parts of a styrene-acrylic resin as binder resin.

Toner 1 was obtained by mixing 100 parts of toner particle 1 using a Henschel mixer (Mitsui Miike Chemical Engineering Machinery Co., Ltd.) with 0.8 parts of a hydrophobic silica fine powder provided by carrying out a hexamethyldisilazane treatment on a dry silica fine powder having a BET value of 300 $m^2/g$ (primary particle diameter=8 nm).

The weight-average particle diameter (D4) of toner 1 was 7.8 μm. The properties of toner 1 are given in Table 6.

<Production Example for Toners 2 to 23 and 25 to 32 and Comparative Toners 1 to 5>

Toners 2 to 23 and 25 to 32 and comparative toners 1 to 5 were obtained proceeding as in the production of toner 1, but changing the type and number of parts of the colorant, crystalline polyester, and wax and the cooling step as shown in Table 5. The formulation and production method are shown in Table 5.

All of the toners had a glass transition temperature in the range from 50° C. to 60° C. and a weight-average particle diameter (D4) of 6.0 μm to 9.0 μm.

The "cooling rate" in Table 5 is described as follows.

The condition designated "40° C./min" indicates that, as in the Toner 1 Production Example, in the cooling step the suspension was cooled at 40° C./min from 100° C. to 50° C. followed by spontaneous cooling to normal temperature.

The condition designated "three-hour anneal" indicates that the cooling step was carried out as follows: cooling from 100° C. to 55° C. at 0.5° C./min; maintenance for 3 hours at 55° C. (the crystallization peak position of the CPES±3° C. is preferred); then spontaneous cooling to normal temperature.

The condition designated "20-minute anneal" indicates that the cooling step was carried out as follows: cooling from 100° C. to 55° C. at 0.5° C./min; maintenance for 20 minutes at 55° C.; then spontaneous cooling to normal temperature.

The condition designated "0.5° C./min" indicates that in the cooling step the suspension was cooled at 0.5° C./min from 100° C. to 50° C. followed by spontaneous cooling to normal temperature.

<Toner 24 Production Example>

| | |
|---|---|
| acrylic resin (VS-1057 from SEIKO PMC CORPORATION) | 100.0 parts |
| metal complex of a monoazo dye (T-77, HODOGAYA CHEMICAL CO., LTD.) | 1.5 parts |
| magnetic body | 90.0 parts |
| ester wax 6 | 5.0 parts |
| crystalline polyester 7 | 5.0 parts |

These starting, materials were preliminarily mixed with a Henschel mixer and were then kneaded with a twin-screw kneader extruder set to 130° C. and 200 rpm. The obtained kneaded material was rapidly cooled to normal temperature, and the cooling rate when this was done was at least 20° C./second. A coarse pulverization was carried out with a cutter mill; the obtained coarsely pulverized material was finely pulverized using a Turbo Mill T-250 (Turbo Kogyo Co., Ltd.) with adjustment of the air temperature to provide an exhaust temperature of 50° C.; and classification using a multigrade classifier based on the Coanda effect was then performed to obtain a toner particle 24. The formulation and production method are given in Table 5.

A toner 24 was obtained by mixing 0.8 parts of a hydrophobic silica fine powder with 100 parts of toner particle 24 as in Toner 1 Production Example.

The weight-average particle diameter (D4) of toner 24 was 8.0 μm. The properties of toner 24 are given in Table 6.

TABLE 5

| | | colorant | | crystalline polyester | | wax | | wax: crystalline | toner production method | |
|---|---|---|---|---|---|---|---|---|---|---|
| | toner particle | colorant type | amount of addition (mass parts) | crystalline polyester No. | amount of addition (mass parts) | wax type | amount of addition (mass parts) | polyester (mass ratio of addition) | production method | cooling rate |
| toner 1 | toner particle 1 | magnetic body | 90.0 | crystalline polyester 1 | 10.0 | ester wax 1 | 10.0 | 1:1 | suspension polymerization | 40° C./min |
| toner 2 | toner particle 2 | magnetic body | 90.0 | crystalline polyester 2 | 10.0 | ester wax 1 | 10.0 | 1:1 | suspension polymerization | 40° C./min |

TABLE 5-continued

| | | colorant | | crystalline polyester | | wax | | wax: crystalline | toner production method | |
|---|---|---|---|---|---|---|---|---|---|---|
| | toner particle | colorant type | amount of addition (mass parts) | crystalline polyester No. | amount of addition (mass parts) | wax type | amount of addition (mass parts) | polyester (mass ratio of addition) | production method | cooling rate |
| toner 3 | toner particle 3 | magnetic body | 90.0 | crystalline polyester 3 | 10.0 | ester wax 1 | 10.0 | 1:1 | suspension polymerization | three-hour anneal |
| toner 4 | toner particle 4 | magnetic body | 90.0 | crystalline polyester 4 | 10.0 | ester wax 1 | 10.0 | 1:1 | suspension polymerization | three-hour anneal |
| toner 5 | toner particle 5 | magnetic body | 90.0 | crystalline polyester 1 | 10.0 | ester wax 1 | 10.0 | 1:1 | suspension polymerization | three-hour anneal |
| toner 6 | toner particle 6 | magnetic body | 90.0 | crystalline polyester 1 | 3.0 | ester wax 1 | 9.0 | 3:1 | suspension polymerization | 40° C./min |
| toner 7 | toner particle 7 | magnetic body | 90.0 | crystalline polyester 1 | 15.0 | ester wax 1 | 10.0 | 2:3 | suspension polymerization | 40° C./min |
| toner 8 | toner particle 8 | magnetic body | 90.0 | crystalline polyester 1 | 15.0 | ester wax 1 | 5.0 | 1:3 | suspension polymerization | three-hour anneal |
| toner 9 | toner particle 9 | magnetic body | 90.0 | crystalline polyester 1<br>crystalline polyester 3 | 5.0<br>5.0 | ester wax 1 | 10.0 | 1:1 | suspension polymerization | 40° C./min |
| toner 10 | toner particle 10 | magnetic body | 90.0 | crystalline polyester 1 | 10.0 | ester wax 1<br>ester wax 4 | 5.0<br>5.0 | 1:1 | suspension polymerization | 40° C./min |
| toner 11 | toner particle 11 | carbond black | 5.5 | crystalline polyester 1 | 10.0 | ester wax 1 | 10.0 | 1:1 | suspension polymerization | 40° C./min |
| toner 12 | toner particle 12 | magnetic body | 90.0 | crystalline polyester 1 | 3.0 | ester wax 1 | 2.0 | 2:3 | suspension polymerization | 40° C./min |
| toner 13 | toner particle 13 | magnetic body | 90.0 | crystalline polyester 1 | 10.0 | ester wax 1 | 2.0 | 1:5 | suspension polymerization | three-hour anneal |
| toner 14 | toner particle 14 | magnetic body | 90.0 | crystalline polyester 1 | 15.0 | ester wax 2 | 15.0 | 1:1 | suspension polymerization | 40° C./min |
| toner 15 | toner particle 15 | magnetic body | 90.0 | crystalline polyester 1 | 10.0 | ester wax 3 | 10.0 | 1:1 | suspension polymerization | 40° C./min |
| toner 16 | toner particle 16 | magnetic body | 90.0 | crystalline polyester 1 | 10.0 | ester wax 4 | 10.0 | 1:1 | suspension polymerization | 40° C./min |
| toner 17 | toner particle 17 | magnetic body | 90.0 | crystalline polyester 1 | 2.0 | ester wax 4 | 10.0 | 5:1 | suspension polymerization | 40° C./min |
| toner 18 | toner particle 18 | magnetic body | 90.0 | crystalline polyester 1 | 20.0 | ester wax 4 | 16.0 | 3:4 | suspension polymerization | 40° C./min |
| toner 19 | toner particle 19 | magnetic body | 90.0 | crystalline polyester 5 | 10.0 | ester wax 4 | 10.0 | 1:1 | suspension polymerization | 40° C./min |
| toner 20 | toner particle 20 | magnetic body | 90.0 | crystalline polyester 6 | 10.0 | ester wax 4 | 10.0 | 1:1 | suspension polymerization | 40° C./min |
| toner 21 | toner particle 21 | magnetic body | 90.0 | crystalline polyester 7 | 10.0 | ester wax 4 | 10.0 | 1:1 | suspension polymerization | 40° C./min |
| toner 22 | toner particle 22 | magnetic body | 90.0 | crystalline polyester 7 | 10.0 | ester wax 5 | 10.0 | 1:1 | suspension polymerization | 40° C./min |
| toner 23 | toner particle 23 | magnetic body | 90.0 | crystalline polyester 7 | 10.0 | ester wax 6 | 10.0 | 1:1 | suspension polymerization | 40° C./min |
| toner 24 | toner particle 24 | magnetic body | 90.0 | crystalline polyester 7 | 5.0 | ester wax 6 | 5.0 | 1:1 | kneading and polymerization | — |
| toner 25 | toner particle 25 | magnetic body | 90.0 | crystalline polyester 7 | 15.0 | paraffin wax 1 | 20.0 | 4:3 | suspension polymerization | 40° C./min |
| toner 26 | toner particle 26 | magnetic body | 90.0 | crystalline polyester 7 | 15.0 | paraffin wax 2 | 20.0 | 4:3 | suspension polymerization | 40° C./min |
| toner 27 | toner particle 27 | magnetic body | 90.0 | crystalline polyester 7 | 15.0 | paraffin wax 3 | 20.0 | 4:3 | suspension polymerization | 40° C./min |
| toner 28 | toner particle 28 | magnetic body | 90.0 | crystalline polyester 1 | 2.5 | ester wax 1 | 2.0 | 4:5 | suspension polymerization | 40° C./min |
| toner 29 | toner particle 29 | magnetic body | 90.0 | crystalline polyester 1 | 22.0 | ester wax 4 | 15.0 | 15:22 | suspension polymerization | 40° C./min |
| toner 30 | toner particle 30 | magnetic body | 90.0 | crystalline polyester 7 | 10.0 | ester wax 7 | 10.0 | 1:1 | suspension polymerization | 40° C./min |
| toner 31 | toner particle 31 | magnetic body | 90.0 | crystalline polyester 7 | 10.0 | ester wax 8 | 10.0 | 1:1 | suspension polymerization | 40° C./min |
| toner 32 | toner particle 32 | magnetic body | 90.0 | crystalline polyester 7 | 10.0 | ester wax 9 | 10.0 | 1:1 | suspension polymerization | 40° C./min |
| comparative toner 1 | comparative toner particle 1 | magnetic body | 90.0 | crystalline polyester 1 | 15.0 | paraffin wax 4 | 20.0 | 4:3 | suspension polymerization | 40° C./min |

TABLE 5-continued

| | | colorant | | crystalline polyester | | wax | | wax: crystalline | toner production method | |
|---|---|---|---|---|---|---|---|---|---|---|
| | toner particle | colorant type | amount of addition (mass parts) | crystalline polyester No. | amount of addition (mass parts) | wax type | amount of addition (mass parts) | polyester (mass ratio of addition) | production method | cooling rate |
| comparative toner 2 | comparative toner particle 2 | magnetic body | 90.0 | crystalline polyester 1 | 10.0 | paraffin wax 1 | 10.0 | 1:1 | suspension polymerization | 40° C./min |
| comparative toner 3 | comparative toner particle 3 | magnetic body | 90.0 | crystalline polyester 1 | 10.0 | paraffin wax 1 | 10.0 | 1:1 | suspension polymerization | 40° C./min |
| comparative toner 4 | comparative toner particle 4 | magnetic body | 90.0 | crystalline polyester 1 | 10.0 | ester wax 6 | 10.0 | 1:1 | suspension polymerization | 0.5° C./min |
| comparative toner 5 | comparative toner particle 5 | magnetic body | 90.0 | crystalline polyester 1 | 10.0 | ester wax 6 | 10.0 | 1:1 | suspension polymerization | 20-minute anneal |

TABLE 6

| | presence of at least 2 peaks at 40-80° C. | ΔH(100) (J/g) | ΔH(0.5) (J/g) | ΔH(100)/ ΔH(0.5) | Tp (° C.) | Tw (° C.) | Tw-Tp (° C.) | domain diameter (nm) | number of domains (number) |
|---|---|---|---|---|---|---|---|---|---|
| toner 1 | present | 8.1 | 2.2 | 3.7 | 55 | 75 | 20 | 120 | 90 |
| toner 2 | present | 7.9 | 2.1 | 3.8 | 54 | 75 | 21 | 130 | 80 |
| toner 3 | present | 8.2 | 2.3 | 3.6 | 52 | 75 | 23 | 200 | 25 |
| toner 4 | present | 7.4 | 2.4 | 3.1 | 56 | 75 | 19 | 260 | 12 |
| toner 5 | present | 7.5 | 2.0 | 3.8 | 55 | 75 | 20 | 220 | 32 |
| toner 6 | present | 3.7 | 0.7 | 5.3 | 55 | 75 | 20 | 100 | 8 |
| toner 7 | present | 13.2 | 3.0 | 4.4 | 55 | 75 | 20 | 55 | 300 |
| toner 8 | present | 10.9 | 3.2 | 3.4 | 55 | 75 | 20 | 320 | 22 |
| toner 9 | present | 6.5 | 1.5 | 4.3 | 52 | 75 | 23 | 150 | 80 |
| toner 10 | present | 6.3 | 2.2 | 2.9 | 55 | 75 | 20 | 160 | 30 |
| toner 11 | present | 7.6 | 2.2 | 3.5 | 55 | 75 | 20 | 125 | 95 |
| toner 12 | present | 2.6 | 0.8 | 3.3 | 55 | 75 | 20 | 30 | 6 |
| toner 13 | present | 4.8 | 2.3 | 2.1 | 55 | 75 | 20 | 500 | 2 |
| toner 14 | present | 14.8 | 3.1 | 4.8 | 55 | 72 | 17 | 55 | 420 |
| toner 15 | present | 7.6 | 2.3 | 3.3 | 55 | 77 | 22 | 180 | 60 |
| toner 16 | present | 9.2 | 2.2 | 4.2 | 55 | 73 | 18 | 70 | 300 |
| toner 17 | present | 3.2 | 0.6 | 5.3 | 55 | 73 | 18 | 90 | 30 |
| toner 18 | present | 15.0 | 3.4 | 4.4 | 55 | 73 | 18 | 20 | 470 |
| toner 19 | present | 7.8 | 2.1 | 3.7 | 56 | 73 | 17 | 160 | 50 |
| toner 20 | present | 7.9 | 2.2 | 3.6 | 55 | 73 | 18 | 140 | 70 |
| toner 21 | present | 5.9 | 2.3 | 2.6 | 55 | 73 | 18 | 55 | 10 |
| toner 22 | present | 6.2 | 2.3 | 2.7 | 55 | 75 | 20 | 60 | 15 |

TABLE 6-continued

| | presence of at least 2 peaks at 40-80° C. | ΔH(100) (J/g) | ΔH(0.5) (J/g) | ΔH(100)/ ΔH(0.5) | Tp (° C.) | Tw (° C.) | Tw-Tp (° C.) | domain diameter (nm) | number of domains (number) |
|---|---|---|---|---|---|---|---|---|---|
| toner 23 | present | 6.8 | 2.2 | 3.1 | 55 | 75 | 20 | 60 | 15 |
| toner 24 | present | 4.6 | 2.3 | 2.0 | 55 | 75 | 20 | 60 | 10 |
| toner 25 | present | 5.9 | 2.9 | 2.0 | 55 | 75 | 20 | 0 | 0 |
| toner 26 | present | 6.0 | 2.9 | 2.1 | 55 | 70 | 15 | 0 | 0 |
| toner 27 | present | 6.2 | 2.9 | 2.1 | 55 | 52 | −3 | 0 | 0 |
| toner 28 | present | 2.3 | 0.7 | 3.3 | 55 | 75 | 20 | 25 | 7 |
| toner 29 | present | 15.5 | 3.4 | 4.6 | 55 | 73 | 18 | 22 | 485 |
| toner 30 | present | 5.8 | 2.3 | 2.5 | 55 | 68 | 13 | 56 | 10 |
| toner 31 | present | 4.6 | 2.3 | 2.1 | 55 | 85 | 30 | 60 | 7 |
| toner 32 | present | 4.6 | 2.2 | 2.1 | 55 | 61 | 6 | 65 | 8 |
| comparative toner 1 | only 1 | 5.8 | 2.9 | 2.0 | 55 | 90 | 35 | 0 | 0 |
| comparative toner 2 | present | 4.2 | 2.3 | 1.8 | 55 | 75 | 20 | 0 | 0 |
| comparative toner 3 | present | 4.5 | 2.4 | 1.9 | 55 | 75 | 20 | 0 | 0 |
| comparative toner 4 | present | 4.8 | 2.5 | 1.9 | 55 | 75 | 20 | 620 | 1 |
| comparative toner 5 | present | 4.6 | 2.4 | 1.9 | 55 | 75 | 20 | 280 | 6 |

Example 1

(Evaluation 1. Initial Developing Performance)

An LBP-6300 (Canon, Inc.) was need as the image-forming apparatus.

The cartridge used was a modified cartridge provided by changing the developing sleeve from a sleeve with a diameter of 14 mm to a sleeve with a diameter of 10 mm.

The use of a cartridge bearing a small-diameter sleeve enables a rigorous evaluation of the developing performance and particularly the image density by reducing the development opportunity for the toner from the developing sleeve to the photosensitive drum.

Using this modified cartridge and toner 1 and operating in a high-temperature, high-humidity environment (32.5° C./80% RH), a test was run in which 100 prints of an image were output, followed by the output of one solid black print and measurement of its image density.

Carrying out the evaluation in a high-temperature, high-humidity environment (32.5° C./80% RH) enables a rigorous evaluation of the image density for the case in which the charging stability of the toner has been reduced.

According to the results for this evaluation of toner 1, the image density was high and an excellent image could be obtained. The results of the evaluation are given in Table 7. The numerical values in ( ) in the table are the image density.

The evaluation criteria for the image density are as follows.

<Image Density>

For the image density, a solid black image region was formed and the density of this solid black image was measured using a Macbeth reflection densitometer (Macbeth Corporation).

The evaluation criteria for the reflection density of the solid black image on the first print after the output of 100 image prints are as follows.

A: very good (at least 1.45)

B: good (at least 1.40 and less than 1.45)

C: average (at least 1.35 and less than 1.40)

D: poor (less than 1.35)

(Evaluation 2. Back End Offset)

The modified apparatus used in evaluation 1 was used as the image-forming apparatus; in addition, temperature control for the fixing unit was lowered and was made 200° C. A modified cartridge as used in evaluation 1 was similarly used as the cartridge. Operating in a high-temperature, high-humidity environment (32.5° C./80% RH), the following evaluation was performed using a regime in which the fixing unit was removed between evaluations and the fixing unit was thoroughly cooled using, for example, a fan. The fixing performance of the toner can be rigorously evaluated with good reproducibility by having thoroughly cooled the fixing unit post-evaluation to cool the temperature of the cooling nip part, which is elevated after image output.

A 90 g/m$^2$ paper that had been conditioned (paper held for at least 48 hours in the high-temperature, high-humidity environment indicated above) was used in the evaluation of the back end offset. The fixing performance can be more rigorously evaluated by using a relatively heavy paper, and the back end offset can be rigorously evaluated by using the conditioned paper.

A solid black image was output on the conditioned paper using toner 1 in a state in which the fixing unit had been thoroughly cooled. The toner laid-on amount on the paper at this time was adjusted to 9 g/m$^2$. According to the results for the evaluation of toner 1, an excellent solid black image was obtained free of speckling. The evaluation criteria used for back end offset are as follows.

<Back End Offset>

For the back end offset, the level of speckling was visually evaluated on the solid black image output using the procedure described above. The evaluation criteria for back end offset are as follows.

A: very good (speckling is completely absent)
B: good (some speckling is seen upon close examination)
C: average (speckling is seen, but is not conspicuous)
D: poor (speckling is conspicuous)

(Evaluation 3. Fogging After Heat Cycling)

A modified cartridge as described above was introduced into an environmental test chamber at a temperature of 45° C. and a humidity of 90% RH and after 12 hours was transferred to an environmental test chamber at a temperature of 25° C. and a humidity of 60% RH. After another 12 hours, it was introduced into an environmental test chamber at a temperature of 45° C. and a humidity of 90% RH. After this procedure had been carried out repetitively 30 times, the modified cartridge was installed in the image-forming apparatus used in evaluation 1 in an atmosphere with a temperature of 32.5° C. and a humidity of 80% RH; two solid white prints were made; and fogging on the second one was measured by the method given below.

The evaluation criteria for the fogging are as follows.

<Fogging After Heat Cycling>

The level of fogging was visually evaluated on the solid white image output using the procedure described above. The evaluation criteria are as follows.

A: very good (fogging is completely inconspicuous)
B: good (some fogging is seen upon close examination)
C: average (fogging is seen, but is not conspicuous)
D: poor (fogging is very conspicuous)

Examples 2 to 32 and Comparative Examples 1 to 5

The same image output tests as in Example 1 were carried out, but changing the toner 1 in Example 1 to toners 2 to 32 and comparative toners 1 to 5. In Example 11, the evaluations were carried out after having modified the image-forming apparatus to enable the output of a nonmagnetic toner. The results of these evaluations are given in Table 7.

TABLE 7

| | | evaluation 1 initial developing performance | evaluation 2 back end offset | evaluation 3 fogging |
|---|---|---|---|---|
| Example 1 | toner 1 | A (1.50) | A | A |
| Example 2 | toner 2 | A (1.49) | A | A |
| Example 3 | toner 3 | A (1.50) | A | A |
| Example 4 | toner 4 | A (1.49) | A | A |
| Example 5 | toner 5 | A (1.49) | A | A |
| Example 6 | toner 6 | A (1.48) | B | A |
| Example 7 | toner 7 | A (1.48) | A | A |
| Example 8 | toner 8 | A (1.47) | B | B |
| Example 9 | toner 9 | A (1.47) | A | A |

TABLE 7-continued

| | | evaluation 1 initial developing performance | evaluation 2 back end offset | evaluation 3 fogging |
|---|---|---|---|---|
| Example 10 | toner 10 | A (1.47) | A | A |
| Example 11 | toner 11 | A (1.48) | A | A |
| Example 12 | toner 12 | A (1.47) | B | A |
| Example 13 | toner 13 | A (1.45) | C | B |
| Example 14 | toner 14 | B (1.44) | A | B |
| Example 15 | toner 15 | A (1.48) | B | B |
| Example 16 | toner 16 | B (1.43) | A | B |
| Example 17 | toner 17 | A (1.47) | B | A |
| Example 18 | toner 18 | B (1.44) | A | B |
| Example 19 | toner 19 | B (1.44) | B | B |
| Example 20 | toner 20 | B (1.44) | B | B |
| Example 21 | toner 21 | B (1.42) | B | B |
| Example 22 | toner 22 | B (1.41) | C | B |
| Example 23 | toner 23 | B (1.40) | C | C |
| Example 24 | toner 24 | C (1.38) | C | C |
| Example 25 | toner 25 | B (1.42) | C | B |
| Example 26 | toner 26 | B (1.41) | C | B |
| Example 27 | toner 27 | C (1.37) | C | C |
| Example 28 | toner 28 | A (1.47) | C | A |
| Example 29 | toner 29 | B (1.42) | A | C |
| Example 30 | toner 30 | B (1.42) | B | B |
| Example 31 | toner 31 | B (1.41) | C | B |
| Example 32 | toner 32 | B (1.41) | B | B |
| Comparative Example 1 | comparative toner 1 | C (1.35) | D | C |
| Comparative Example 2 | comparative toner 2 | C (1.38) | D | C |
| Comparative Example 3 | comparative toner 3 | C (1.38) | D | C |
| Comparative Example 4 | comparative toner 4 | C (1.39) | D | D |
| Comparative Example 5 | comparative toner 5 | C (1.38) | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237660, filed Dec. 4, 2015, which is hereby incorporated by reference herein in its entirety.

What is claimed is:

1. A toner comprising a toner particle containing a binder resin, a colorant, a wax, and a crystalline polyester, wherein, the toner has two or more peak tops for crystallization peaks in a temperature range from 40° C. to 80° C. in a first DSC curve, the first DSC curve being obtained using a differential scanning calorimeter (DSC) by a process of heating the toner to 100° C. and thereafter cooling the toner from 100° C. to 20° C. at 0.5° C./min, and the toner satisfies the following formula $$2.0 \leq (\Delta H(100)/\Delta H(0.5)) \leq 6.0$$

where,

ΔH(0.5) represents an exothermic quantity (J/g) for the crystallization peak on the lowest temperature side of the two or more crystallization peaks in the first DSC curve, and ΔH(100) represents an exothermic quantity (J/g) for the crystallization peak on the lowest temperature side of crystallization peaks having peak tops present in a temperature range from 40° C. to 80° C. in a second DSC curve, the second DSC curve being obtained using the DSC by a process of heating the toner to 100° C. and thereafter cooling the toner from 100° C. to 20° C. at 100° C./min.

2. The toner according to claim 1, wherein ΔH(100) is at least 2.5 J/g and not more than 15.0 J/g.

3. The toner according to claim 1, wherein, the crystalline polyester and the wax satisfy the following formula (1):

$$5 \leq Tw - Tp \leq 30 \quad (1)$$

where,

Tw (° C.) represents a peak temperature of a crystallization peak (Pw) of the wax measured with the DSC by the process of cooling the toner from 100° C. to 20° C. at 0.5° C./min, Tp (° C.) represents a peak temperature of a crystallization peak (Pp) of the crystalline polyester measured with the DSC by the process of cooling the toner from 100° C. to 20° C. at 0.5° C./min.

4. The toner according to claim 1, wherein the wax contains an ester wax, and a peak top temperature of an endothermic peak in differential scanning calorimetric measurement of the ester wax is at least 65° C. and not more than 85° C.

5. The toner according to claim 4, wherein the ester wax is any of an ester compound of a dihydric alcohol and an aliphatic monocarboxylic acid, and an ester compound of a dibasic carboxylic acid and an aliphatic monoalcohol.

6. The toner according to claim 4, wherein the ester wax satisfies the following condition (i) or (ii);

(i) in the ester wax, the proportion of a partial structure given by formula (1) below in alcohol component-derived partial structures is at least 90 mass % and not more than 100 mass %;

(ii) in the ester wax, the proportion of a partial structure given by formula (2) below in acid component-derived partial structures is at least 90 mass % and not more than 100 mass %, and the crystalline polyester satisfies the following condition (iii) or (iv):

(iii) in the crystalline polyester, the proportion of a partial structure given by formula (1) below in alcohol component-derived partial structures is at least 90 mass % and not more than 100 mass %;

(iv) in the crystalline polyester, the proportion of a partial structure given by formula (2) below in acid component-derived partial structures is at least 90 mass % and not more than 100 mass %

(1) $—C_xH_{2x}—O—$ x is an integer from 6 to 12

(2)

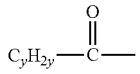

y is an integer from 4 to 10 (hydrogen or oxygen is bonded to the left end of the hydrocarbon chain in formula (1), and hydrogen or a carbonyl group is bonded to the left end of the hydrocarbon chain in formula (2)).

7. The toner according to claim 1, wherein the toner contains at least 3 mass parts and not more than 15 mass parts of the crystalline polyester per 100 mass parts of the binder resin, and the mass ratio between the wax and crystalline polyester (wax/crystalline polyester) is 1/3 to 3/1.

8. The toner according to claim 4, wherein the ester wax contains an ester compound, and in the composition distribution measured for the ester wax by GC-MASS or MALDI TOF MASS, the proportion of the ester compound having the largest content relative to the total amount of the ester wax is at least 40 mass % and not more than 80 mass %.

9. The toner according to claim 1, wherein, in a cross section of the toner observed with a scanning transmission electron microscope (STEM), domains of the crystalline polyester are present, the number-average major axis length of the domains is at least 50 nm and not more than 300 nm, and the number of domains is at least 8 and not more than 500.

10. The toner according to claim 1, wherein ΔH(100) and ΔH(0.5) are exothermic quantities for crystallization peaks originating from the crystalline polyester.

* * * * *